United States Patent [19]

Huhn

[11] 3,941,976

[45] Mar. 2, 1976

[54] VOTE RECORDING

[76] Inventor: M. Susan Huhn, 38 Ridgewood Ave., Groton, Mass. 01450

[22] Filed: May 15, 1974

[21] Appl. No.: 470,156

[52] U.S. Cl. ..... 235/54 F; 235/54 R

[51] Int. Cl.[2] ..... G07C 13/00

[58] Field of Search ..... 235/54 F, 51, 54 R, 55 R

[56] References Cited

UNITED STATES PATENTS

| | | | |
|---|---|---|---|
| 3,108,743 | 10/1963 | Naugle | 235/54 F |
| 3,125,289 | 3/1964 | Aronson | 235/54 R |
| 3,162,362 | 12/1964 | Jazbutis | 235/54 F |
| 3,214,091 | 10/1965 | Clark | 235/54 F |
| 3,226,018 | 12/1965 | Railsback et al. | 235/54 R |
| 3,710,105 | 1/1973 | Oxendine, Jr. et al. | 235/54 F |
| 3,722,793 | 3/1973 | Aronoff | 235/54 F |
| 3,739,151 | 6/1973 | Moldovan, Jr. et al. | 235/54 F |
| 3,744,713 | 7/1973 | Martin et al. | 235/54 F |
| 3,787,662 | 1/1974 | Martin et al. | 235/54 F |
| 3,847,345 | 11/1974 | Moldovan, Jr. et al. | 235/54 F |

*Primary Examiner*—Stephen J. Tomsky
*Attorney, Agent, or Firm*—Charles Hieken; Jerry Cohen

[57] ABSTRACT

An electronic voting machine includes a number of terminals to facilitate accommodating virtually any ballot with nearly the minimum amount of apparatus for the particular ballot. A display lists the candidates for each office beside an identifying tag. A poll worker actuates a switch which enables the apparatus to receive vote selection indicated on a keyboard by the voter. The voter operates a switch to identify the office or issue being voted and then enters his choice on a keyboard to cause a signal representative of his selection to enter a temporary storage means and be illuminated on a display means. The voter turns a switch to the office or issue voted upon, enters a number representative of the candidate or issue decision selected and sees his vote displayed as it enters storage. A circuit arrangement prevents more than a predetermined number of votes for an office from entering storage and indicates an invalid vote on the display when the voter tries to cast more than the authorized number of votes for a particular office or issue. The voter may also indicate his desire to write in for a particular office by entering his choice on a keyboard and operating a switch to identify the choice as a write-in, whereby a signal indicating that a write-in vote is being cast for that office enters temporary storage. If the write-in is valid, the voter may write in his vote for a particular office, and the write-in vote cannot be seen by others until voting is completed and all write-in votes counted. Upon completing his voting, the voter actuates an enter switch that causes transfer of his votes in temporary storage into an appropriate accumulator, such as a computer.

23 Claims, 28 Drawing Figures

VOTE RECORDING

BACKGROUND OF THE INVENTION

The present invention relates in general to automatic vote recording and more particularly concerns novel apparatus and techniques for reliably, rapidly and securely accummulating votes manually entered by voters with relatively economical apparatus characterized by extreme flexibility for accommodating a wide variety of ballot forms, numbers of candidates, offices and acceptable votes for each office. The invention is especially useful in connection with an easily programmed electronic computer for recording the votes, first at the precinct level and thereafter at a central location.

Election results accurately reflecting the choices made by the voters is vital to the democratic process in all kinds of elections, whether they be for governmental offices, changes in laws, or in private elections, such as for offices of an organization. Where the number of voters is small, the paper ballot is acceptable provided honest careful officials supervise the dispensation and counting of ballots. The disadvantages of paper ballots in most large elections are readily apparent. Each vote from each ballot must be manually tallied and accummulated. Apart from the time required, the opportunities for even honest errors is evident. Accordingly, many voting authorities now use automatic techniques for accummulating votes.

A typical approach is the mechanical automatic voting machine. There is one bulky machine for each voting booth. Each machine is individually set up for each electron with a sequence of mechanical adjustments. A voter enters the booth and pulls knobs to register his votes. Opening the curtain registers the votes and readies the machine for the next voter. After the polls close, the count from each machine are manually tabulated in each precinct. Moving these bulky machines in and out of the polling places for each electron is disadvantageous. Storing these bulky machines is costly. Still another disadvantage is the relative inflexibility of these machines. Each machine must have enough voting channels to accommodate the largest number of expected offices and candidates even though most will not be used. The result is costly bulky mechanical machines.

Other automatic counting approaches include the use of manually punched business machine cards and paper ballots marked with a special marking device. Business machines then scan the business machine cards or paper ballots to accummulate the vote totals. These techniques are subject to not insubstantial errors.

For a discussion of prior art in electronic voting machines reference is made to U.S. Pat. No. 3,793,505. Despite the extensive array of prior art in this field, the electronic voting machine of the prior art has not yet made appreciable entry into the automatic voting machine market.

It is an important object of this invention to provide improved apparatus for voting automatically that overcomes one or more disadvantages of prior art apparatus, such as those enumerated above.

It is a further object of the invention to achieve the preceding object with apparatus that is reliable, relatively free from complexity, capable of economically accommodating a wide variety of ballot formats and is especially suitable for use with a simply programmed digital computer.

It is a further object of the invention to achieve one or more of the preceding objects with apparatus that facilitates accommodating write-in votes.

It is a further object of the invention to achieve one or more of the preceding objects with apparatus that enables the voter to observe vote selections before they are entered into the accumulated total and make changes, if desired.

If it a further object of the invention to achieve one or more of the preceding objects with apparatus that may be constructed in modular form via connection of two voting terminals within one booth, or by insertion of additional memory in the format legalizer apparatus, for facilitating accommodating virtually any election while using only essentially the minimum necessary for a given election.

It is still another object of the invention to achieve one or more of the preceding objects with apparatus that may be relatively easily controlled to insure honest voting.

It is still another object of the invention to achieve one or more of the preceding objects while maintaining the secrecy of the ballot.

It is still a further object of the invention to achieve one or more of the preceding objects while maintaining an accurate count of not only the votes cast by a voter but also the number of selections which the voter could but did not choose (blanks).

It is still another object of the invention to achieve one or more of the preceding objects while presenting signals representative of votes in such a manner that a computer may function simply as an accumulator of the votes for each candidate.

Still another object of the invention is to achieve one or more of the preceding objects while providing simple apparatus to prevent a voter from selecting more than a predetermined authorized number of candidates for a particular office.

SUMMARY OF THE INVENTION

According to the invention, there is display means for displaying the candidates for each office beside an associated designation, such as a number, uniquely identifying each candidate, for each office, and uniquely identifying each candidate among all the candidates and issues on that ballot. There is vote selecting means for actuation by a voter to designate the identifying tag of a candidate or issue selected. There is vote display means for indicating the selected vote of the voter then voting. There is temporary storage means for receiving signals representative of each vote cast by the voter then voting. There is also means for selectively cancelling a vote cast by the voter then voting. There is also final selection means responsive to actuation of a voter then voting when satisfied with the vote indicated for effecting transfer of the selected votes from the temporary storage means into means for accumulating the votes being cast, such as a digital computer.

According to another aspect of the invention, there is means responsive to selection of a predetermined number of candidates for an office for preventing entry of another vote for that office into the temporary storage means and for indicating on the display means that the attempt to vote is invalid.

Still another feature of the invention includes means for counting blanks to facilitate accounting for every potential vote.

A further feature of the invention includes means for accepting write-in votes and preventing a subsequent voter from observing the write-in vote while counting the write-in votes.

Numerous other features, objects and advantages of the invention will become apparent from the following specification when read in connection with the accompanying drawing in which:

BRIEF DESCRIPTION OF THE DRAWING

FIG. 1A illustrates the preferred apparatus;

FIG. 4A is a front view of the ballot display board;

FIG. 4B is a view of one candidate display;

FIG. 4C is a side elevation view of the angularly mounted ballot display board shown in FIG. 4A and the horizontal shelf for write-ins shown in FIG. 4D;

FIG. 4D is a top view of the shelf that holds the write-in mechanism and the vote registration mechanism;

FIG. 6A is a side view of the write-in apparatus with the door open and paper exposed to the voter;

FIG. 6B is a top view of the write-in mechanism, with the door closed;

FIG. 6C is a side view of the write-in door closed;

FIGS. 6D and 6E are a magnified view of the lock and switch associated with the write-in door. The lock and switch are controlled by the format legalizer interlock; they in turn control access to the write-in paper area;

With reference now to the drawing, and more particularly FIGS. 1A to 1C thereof, there are illustrated three different configurations of a format legalizer. It is possible to configure the format legalizer in many different ways without changing the basic concepts described herein. The three FIGS. 1A to 1C are shown merely to demonstrate possible alignments, and are not meant to be inclusive. Since the figures contain the same basic components, they are described together. The format legalizer 31A, 31B, 31C serves as the main interlocking mechanism to prevent illegal vote choices. The vote choices are made at the vote selection terminal 32A, 32B, 32C. Only legal choices are indicated to the voter; the voter can erase a vote and have all other previous selections remain. When all desired selections have been made, the votes, along with the blank votes for each office are cast on lines 36A, 36B, 36C in the vote counting apparatus 33A, 33B, 33C. The vote register sequencer 42A, 42B, 42C sequences the transmission of votes from the selection terminals 32A, 32B, 32C, one terminal at a time. Similarly, for the apparatus shown in FIGS. 1A and 1C, the format legalizer sequencer 38A, 38C makes the load requests to the precinct format legalizer 31A, 31C, consecutive, from the selection terminal 32A, 32C, allowing one format legalizer 31 to serve several vote selection terminals 32.

The format legalizer apparatus 31 is uniquely versatile regarding set-up for an election. Set up processes that affect the functioning of the apparatus occur only in the format legalizer apparatus 31, so that vote selection mechanisms in the vote selection terminal 32 and vote registers in the vote counting apparatus 33 are assigned permanent numbers. In conjunction with this, each three candidates are assigned one interlock that is permanently associated with that group. The same basic concept is operative in a mechanism not described herein, but nevertheless intended to be covered by the claims put forth hereinafter, where a group of eight candidates are permanently assigned an interlock that increments to four. In each case, permanent candidate and write-in numbers are associated with permanent interlock numbers.

Figure 1A:
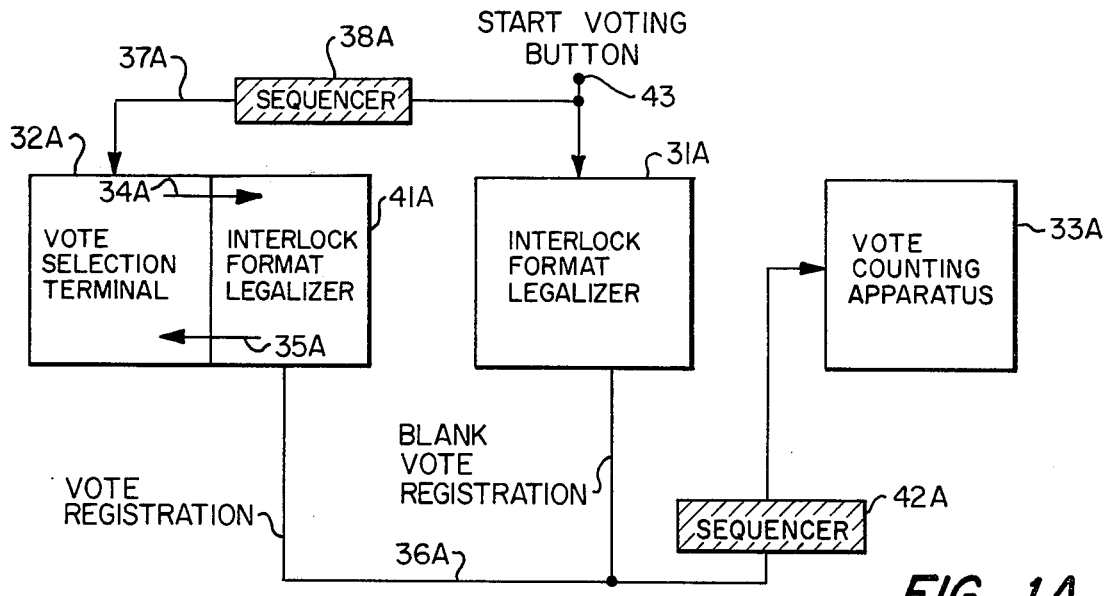
FIGS. 1A, 1B, and 1C are block diagrams showing the three separate components of the novel electronic voting machine and the three alternate ways that the format legalizer can be embodied within the apparatus, where

More specifically, with regard to the separate figures, FIG. 1A shows the preferred method of configuring the format legalizer; one format legalizer 31A serves a precinct by transmitting via a line 37A the election set-up data to a second format legalizer 41A within the vote selection terminal 32A. The precinct format legalizer 31A is set up prior to the election, while the selection format legalizer 41A is reloaded from the precinct format legalizer 31A each time a voter pushes the start voting button 43.

Candidate selections are made in the vote selection terminal 32A, transmitted via a line 34A to the selection module format legalizer 41A to see that the number of choices for that office have not yet been made. Similarly, question selections are checked to see that the question has not been voted. If the selection is legal, it is transmitted back to the vote selection terminal 32A via a line 35A and displayed. Each selection is tested as it is made.

Figure 1B:
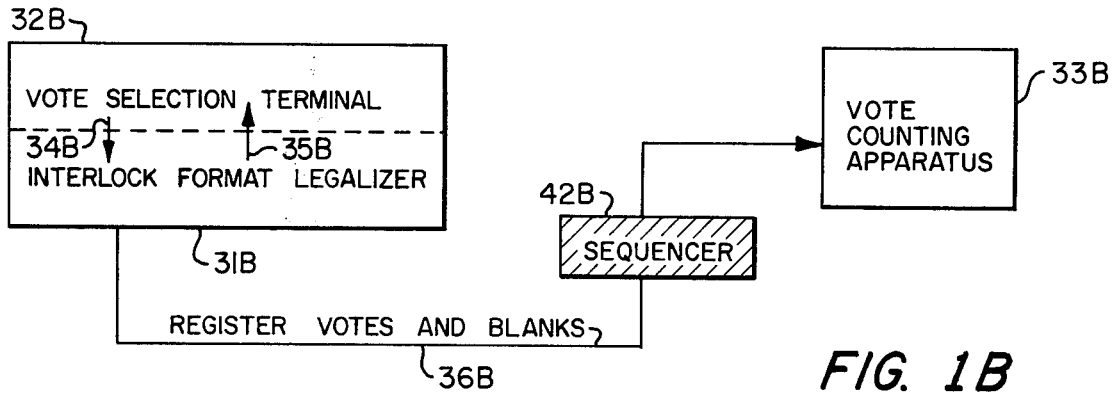

An alternate apparatus, the simplest form, is the one shown in FIG. 1B. The format legalizer 31B is connected inextricably to the vote selection terminal 32B; each format legalizer 31B is set up prior to the election. Vote selections are sent via a line 34B and returned via a line 35B to be displayed if they are legal.

Figure 1C:
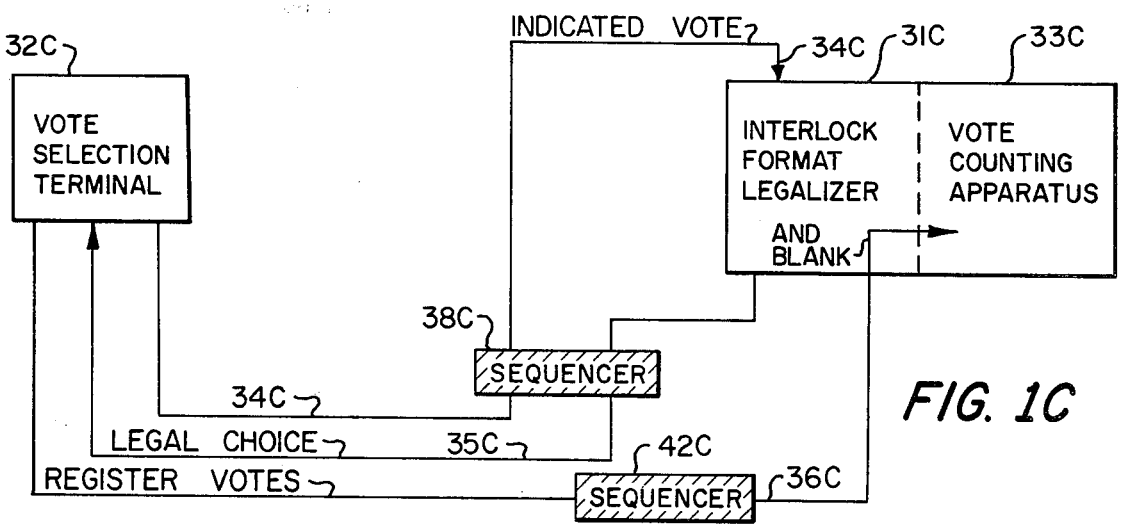

FIG. 1C illustrates a second alternate configuration. Here, one format legalizer 31C serves an entire precinct. All vote choices from the several vote selection terminals 32C are transmitted on a line 34 through a sequencer 38C to one format legalizer 31C for a test of legality. A line 35C transmits legal choices from the format legalizer 31C back through the sequencer 38C to the correct vote selection terminal 32C for display.

Figure 2:
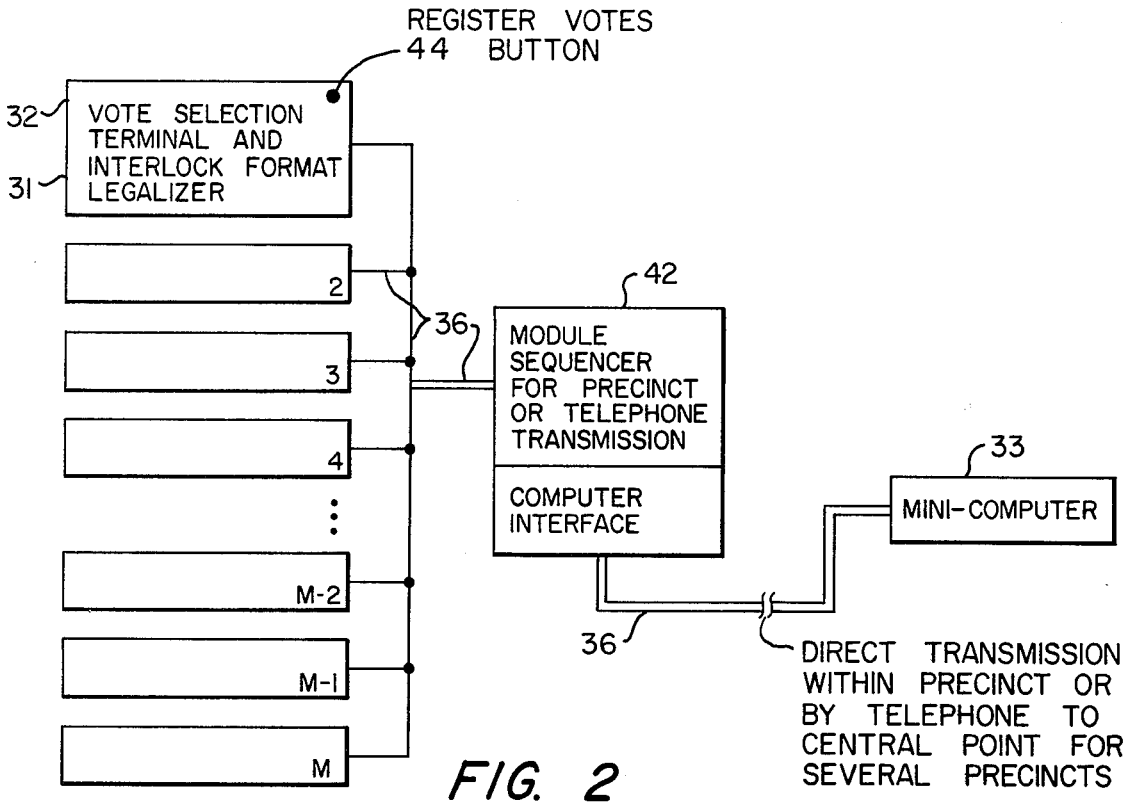
FIG. 2 is a block diagram of the apparatus set up in a precinct for an electron. The apparatus embodies a sequencer to time transmission of vote choices from multiple voting booths to a single counting apparatus, in this case a mini-computer.

Referring to FIG. 2 is a block diagram showing multiple vote selection terminals 32, numbered 1 to *m*, connected to a central vote counting apparatus 33. Each terminal 32 contains some configuration of vote selection terminals 32 and format legalizers 31 or processing to a central precinct format legalizer 31 as described in FIGS. 1A to 1C. Choice of configuration depends on the typical elections that prevail in the county, state, or country purchasing the vote counting apparatus. Data is transmitted from the selection terminal 32 to the vote counting minicomputer 33 in the following manner: after a voter has finished making selections, he pushes a register votes button 44 that produces a unique signal for vote terminal sequencing by the sequencer 42 in a manner well-known in the state of the art, for data coding by the computer interface 42 in a manner well known, and for transmission on a line 36 for input to the computer 33. The data may be further coded by the computer interface 42 in a manner well-known, for telephone transmission to a remote computer. The vote terminal sequencer 42 and the minicomputer 33 will frequently be housed in the same casing and not be discernable as separate components to the onlooker.

Figure 3C:
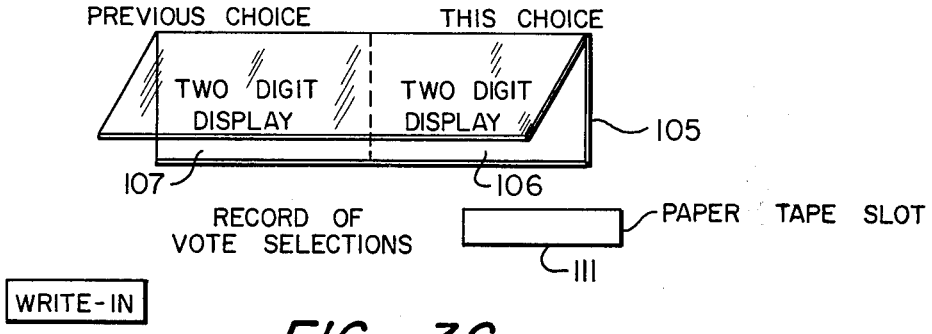
FIG. 3C is a top view of an alternate candidate choice display and a paper tape slot for record of the vote selections.
Figure 3D:
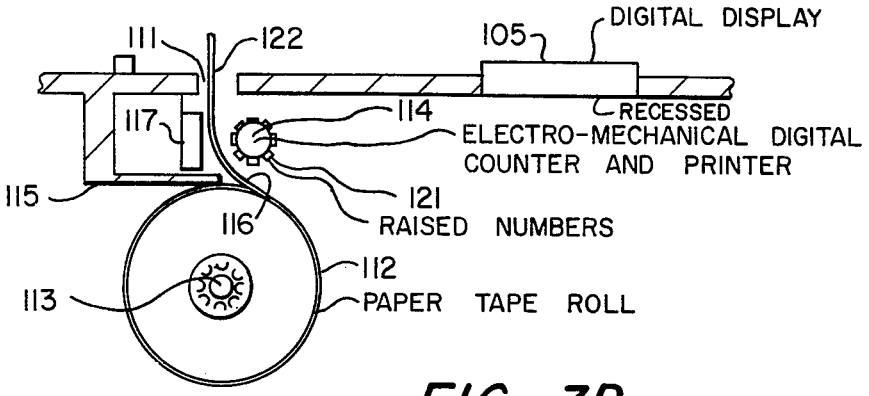
FIG. 3D is a side view of the paper tape apparatus, showing the tape, the feeder, the electro-mechanical digital counter and a printing mechanism.
Figure 3A:
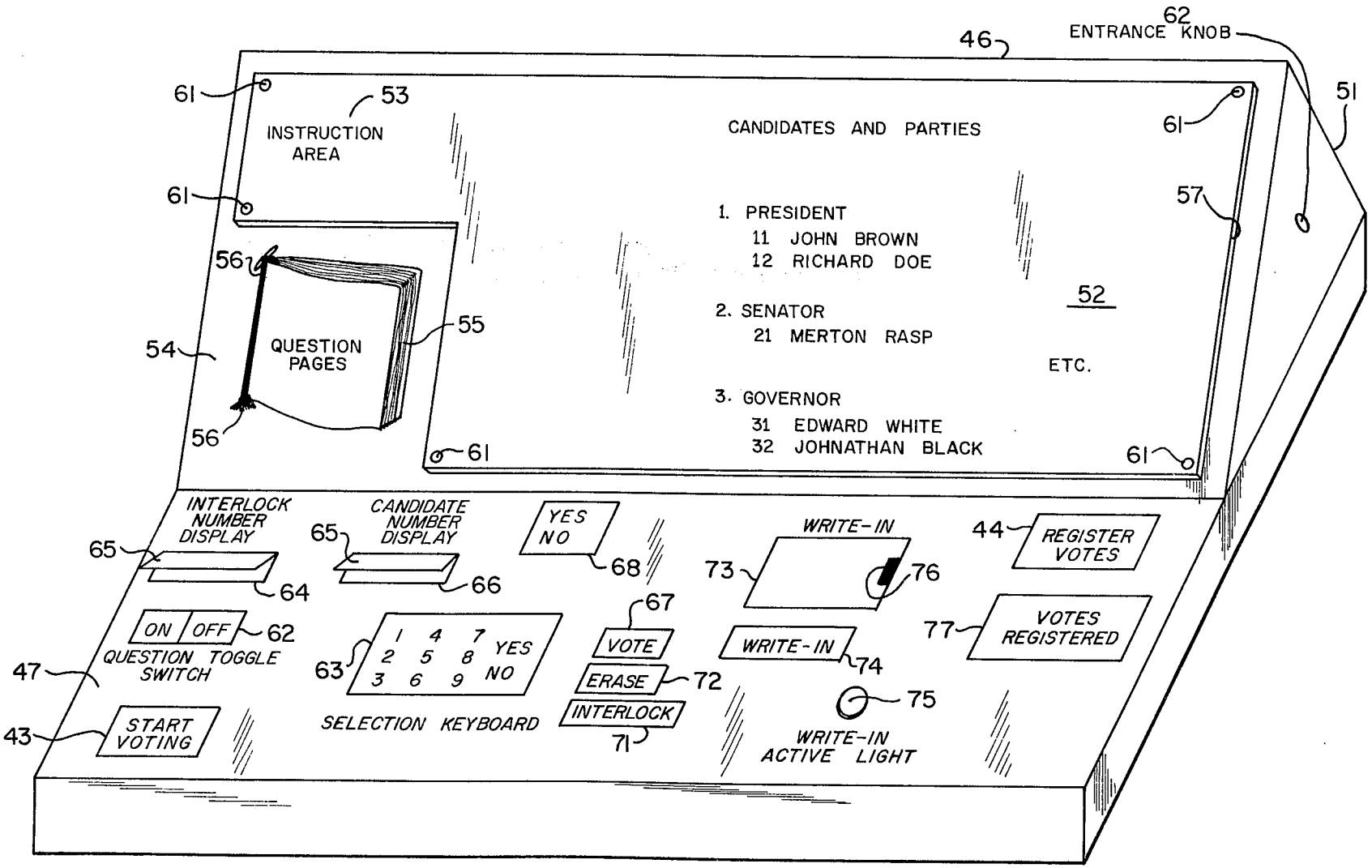
FIG. 3A is a perspective view of the preferred vote selection terminal, where offices, candidates, and questions are displayed on a board and selections are made in a separate area by reference to a code associated with each possible choice.

With reference to FIG. 3A, there is shown a perspective view of the preferred embodiment of the vote selection terminal 32A. The terminal 32, with a casing 51, is divided into two main sections, the nearly vertical ballot display area 46, and the nearly horizontal vote selection area 47. On the ballot display area 46 there are: the candidates and party designations 52 which may appear in any of the three standard ballot formats, horizontal, vertical, or Australian paper ballot; the instruction area 53 which lists simplified instructions to the voter for machine operation; and the question area 54 which presents the questions on paper inserts into plexiglass pages 55. After the questions are inserted for a particular election, the pages are locked in place for the duration of the election with two locks 56. A removable plexiglass shield 57 covers the instruction area and candidate display area. Locks 61 permit the removal of the plexiglass shield for insertion of the candidate ballot prior to election day and permit locking of the shield for the duration of the election as a protection against fraudulent or erroneous mutilation of the printed ballot. Each candidate name, party, and question has an associated code printed on the ballot. Voter choices are made in the vote selection area by reference to this code.

In the vote selection ares 47, vote choices are made in a step by step manner. First the voter pushes the start voting button 43 which is connected to the election officer's entrance knob 62. If the person is a qualified voter, the election officer will have pressed the entrance knob 62, and the start voting button 43 will activate the voting mechanism. Secondly, the voter chooses to vote questions by putting the question toggle switch 62 on, or off to vote offices. The voter then keys the desired candidate or question number on the vote selection keyboard 63, which could alternately be a dial or thumb wheel arrangement. Then he pushes the vote button 67 or the interlock button 71 for questions. For candidate choices, the interlock number display 64 shows the first digit, and the candidate display 66 shows the second digit, for one or several candidates. Yes or no votes are shown on the question display 68. The displays may be covered by a slanted, raised, tinted plexiglass shield 65 to prevent excessive light from dimming the choice displayed. Instead of a vote selection area 47 that is fixed to the voting booth, the selection apparatus may be in the form of a hand-held calculator-type keyboard that is connected by wires to the format legalizer 31. A hand-held selection device would allow the voter to associate choices with the display most closely.

Candidate choices are indicated only if they are legal, that is, if the office with which that choice is associated has not yet been voted the total number of times legally permitted. Not all candidate choices for an office will be displayed at the same time; in an office where the size of the candidate display exceeds the number of vote fors, not all choices for that office can be displayed at one time. While it is possible to build a unit that displays more choices, such a unit is not as economically feasible as the preferred embodiment of the apparatus. However, the building of such a unit is within the principles of the invention and may be especially advantageous should LED displays become cheaper in the future. Any number of candidate selection digital displays are within the scope of the invention.

In the preferred implementation of the apparatus, to erase a selection before the votes have been registered, (it is impossible to erase after the votes have been registered), the voter merely revotes the particular selection he desires to erase, and pushes the erase button 72. The erase button 72 is not necessary because an erase merely complements a vote, but it is a convenience to the voter.

A door 73 provides access to a paper which serves as the write-in area for the entire voting machine ballot on the preferred apparatus of FIG. 3A. To write in, the office interlock number is keyed on the vote selection keyboard 63 and the write-in button 74 is pushed. This creates the same search for a legal vote as a vote button 67 does for a candidate number selection 63. However, write-in votes cannot be erased. If the write-in is legal, the office number is automatically printed on the write-in paper, and the write-in active light 75 is illuminated. The voter opens the door 73 of the write-in box by pushing toward the left with the thumb tab 76 to expose the paper. The voter can then write-in one choice for the office; since the office number has been printed on the paper, the write-in is a unique vote. The write-in process can recur as often as there are legal choices available.

The total write-ins, plus the total votes, plus the total blanks for an office provide proof of complete accuracy of the electronic voting system, because they add up to the number of people who voted in the precinct. The invention thus provides a real cross check for accuracy of the vote count.

The register votes button 44, when pushed, deactivates the vote selection module to prohibit further voting by that voter and signals the vote counting apparatus to register all the votes and blank votes from that terminal. When the votes and blanks are counted, a signal is returned, and the votes registered light 77 is lighted, and stays lighted until the vote selection terminal is reactivated by the election officer entrance knob 62 in preparation for the next voter.

Table A is an illustration of the three ballot formats any of which may be presented to the voter with equal facility on the ballot display area 46 of the preferred embodiment of the vote selection terminal 32. The horizontal ballot display features the parties listed vertically, the offices listed horizontally, and the candidates in one party listed horizontally one beside each other. The vertical ballot display features the parties listed horizontally, the offices listed vertically and the candidates of one party listed vertically one under the other. The Australian paper ballot format displays the first office, the candidates for the first office, the party with which each particular candidate is affiliated, and lists the remaining offices in sequence in the same format. A number code is associated with each candidate's name. Table A is set forth on the following page.

TABLE A

| BALLOT FORMAT | HORIZONTAL, VERTICAL, AND AUSTRALIAN PAPER BALLOT ARRANGEMENTS | | | | |
|---|---|---|---|---|---|
| HORIZONTAL | | | | | |
| | President | Governor | Senate | U.S. Representative | Superior Court Judge |
| Democratic | 11 DOE | 21 CROW | 31 SOCK | 41 SALVESEN | 51 JONES |
| Republican | 12 RACK | 22 HAWK | 32 SACK | 42 SVEDLOCK | |
| Socialist | 13 MOSS | | | 43 SWANSON | |
| Labor | 14 RATHBONE | | | | |
| Independent | 15 LIVINGSTONE | | | | |
| VERTICAL | | | | | |
| | Democratic | Republican | Socialist | Labor | Independent |
| President | 11 DOE | 12 RACK | 13 MOSS | 14 RATHBONE | 15 LIVINGSTONE |
| Governor | 21 CROW | 22 HAWK | | | |
| Senate | 31 SOCK | 32 SACK | | | |
| U.S. Representative | 41 SALVESEN | 42 SVEDLOCK | | | |
| AUSTRALIAN PAPER BALLOT | | | | | |
| President | | U.S. Representative | | | |
| 11 DOE | | 41 SALVESEN | | | |
| 12 RACK | | 42 SVEDLOCK | | | |
| 13 MOSS | | 43 SWANSON | | | |
| 14 RATHBONE | | Superior Court Judge | | | |
| 15 LIVINGSTONE | | 51 JONES | | | |
| Governor | | | | | |
| 21 CROW | | | | | |
| 22 HAWK | | | | | |
| Senate | | | | | |
| 31 SOCK | | | | | |
| 32 SACK | | | | | |

Figure 3B:
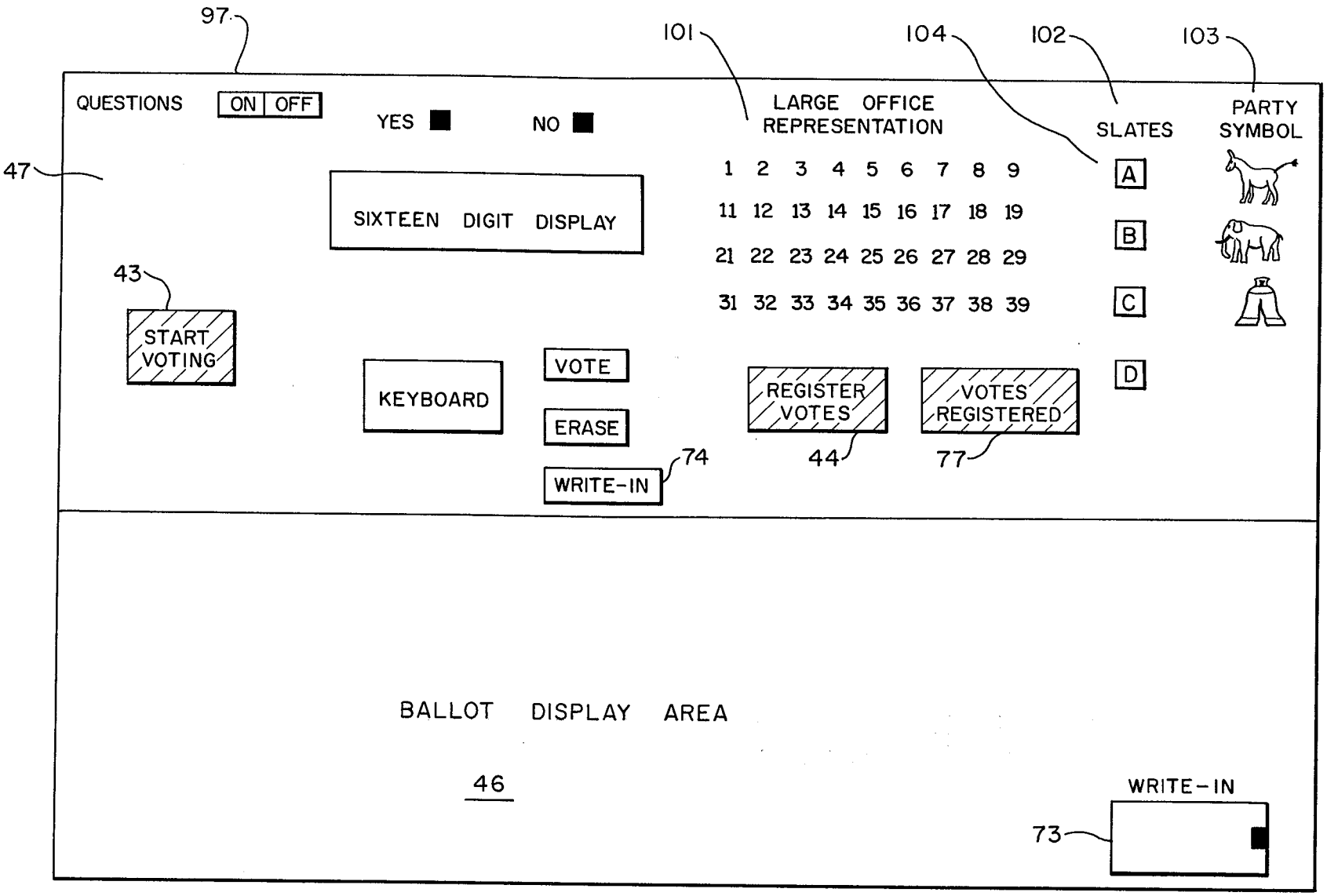
FIG. 3B shows an alternate configuration of the ballot display area and the vote selection area, an optional large office representation, and a slate voting display.

Referring to FIG. 3B there is shown an alternate embodiment of the vote selection terminal 32 with the ballot display area 46 located below the vote selection area 47. A tinted plexiglass shield 97 shades the entire vote selection area 47. The write-in indication button 74 remains in the vote selection area 47. The write-in door 73 is in the ballot display area 46.

Also shown is an optional device, the large office display 101 which is a board of numbers that light. Another optional device is the slate voting device 102 whereby party symbols are listed 103 and associated with buttons 104 that light when a particular slate is chosen, a light button 104 representing a legal selection.

Referring to FIG. 3C there is shown the top view of an alternate candidate display and a selection tape option. Legal votes appear as selected on the digital display 105 in the area THIS CHOICE 106; the previous selection moves to area PREVIOUS 107, and in addition is printed on a rolled paper tape that is dispensed continuously from a slot 111. All legal selections are held in a vote selection memory 173 (FIG. 11) to be reviewed by the voter if so desired, and ready for transmission to the vote counting apparatus when the register votes button 44 is pushed. The paper tape of selections and erased votes is removed by the voter after he has completed voting.

FIG. 3D is a side view of the vote selection tape apparatus shown in FIG. 3C. The paper tape roll 112 is mounted on a ratchet 113 that turns automatically each time a number is printed by the electromechanical counter 114. The counter 114 is set to the code displayed in area PREVIOUS CHOICE 107, that is, the previous legal candidate choice. The voter has the opportunity to erase the present candidate choice. The voter has the opportunity to erase the present selection, before it prints on the tape record of his votes. A feeder 115 guides the paper tape 116 to the printing block 117. The counter 114 has raised numbers 121 that are imprinted on the paper tape 116 at the appropriate time, by pressure exerted from the block and carbon ribbon 117. As the ratchet 113 turns, the tape 122 of this voter's previous selections appears through a slot 111.

Figure 4A:
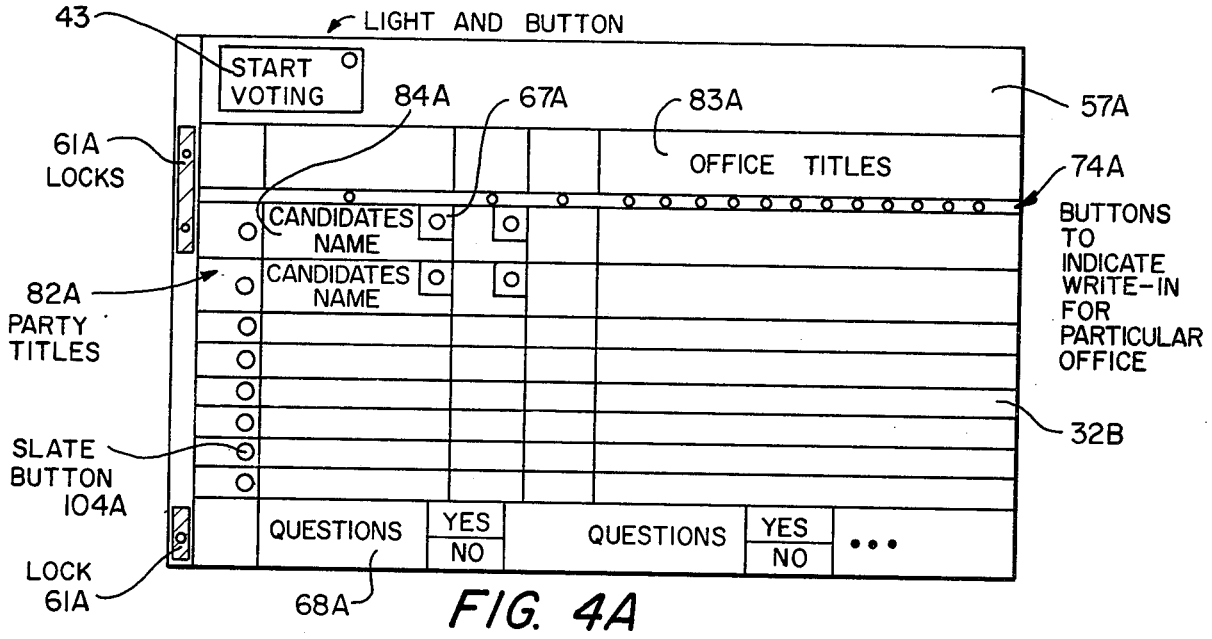
FIGS. 4A to 4D show an alternate vote selection terminal which has lights and switches associated with each name, slate, or question; more particularly.

Referring to FIGS. 4A to 4D, there is shown an alternate implementation of the vote selection terminal apparatus that provides light and switches associated with each choice. FIG. 4A shows a front view of a display board with lights and switches. This board can be mounted lengthwise to provide a vertical ballot display format or an Australian paper ballot format, or it can be mounted sideways, as is demonstrated herein to provide a horizontal ballot display. Ballot format presentation is flexible.

The start voting button 43 activates the machine for voting. The voter makes choices by referring to office titles 83A, party label affiliations 82A, and the candidate names 84A, then pushing the vote button 67A associated with a particular candidate. Slate voting takes place by pushing a slate button 104A.

Figure 4B:
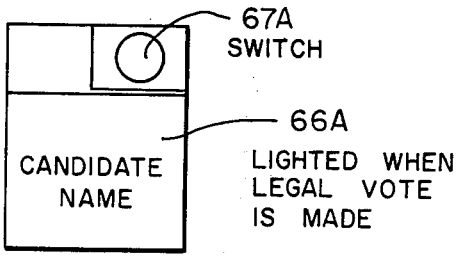

FIG. 4B is an enlarged view of the vote button 67A associated with each candidate name. When the button 67A is pushed, the candidate vote display 66A lights an elevator button, but with a name instead of a number. It lights if and only if a legal vote choice has been made. All vote select keys and buttons 67 are non-bounce, of a type well-known to those skilled in the art, so that only one vote is made per indication.

Referring again to FIG. 4A the question area has a yes and no button 68A associated with each question where the yes or no button will light to indicate a choice, but both cannot be chosen for the same question. Each office column 83A has an associated write-in indicator button 74A that tests the format legalizer main interlock to see if the write-in for that office will represent a legal choice, and if so, it activates the write-in active light 75. The entire display board is covered with a removable plexiglass cover 57A that is locked on by the ballot locks 61A which prevent access to any portion of the ballot during the election.

Figure 4C:
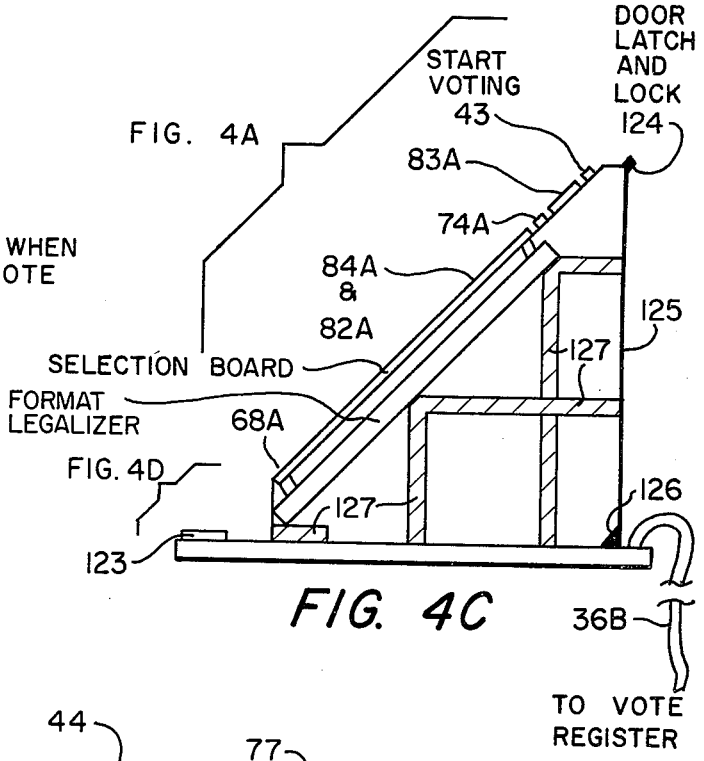

With reference to FIG. 4C, there is shown a side elevation view of the casing for the vote selection terminal 32B. The display board of FIG. 4A is mounted at a slant with the start voting button 43 at the top, the office title captions 83A immediately below, the office write-in bottons 74A next, the candidate 82A and party display 84A below these, and last come the question displays 68A. The vote selection terminal 32B is of the type illustrated in the block diagram of FIG. 1B, where there is a format legalizer 31B associated with each terminal mounted directly beneath the selection board 32B by struts 127. Access to the back of the format legalizer is provided by opening latch and lock 124, to open the door 125, which swings on a hinge 126. Access is needed for the purpose of setting the format legalizer for the particular election, prior to election day. On election day, the door 125 remains locked.

Data from the selection board 32B is transmitted on a line 36B to the vote counting apparatus 33B (FIG. 1B) after the register votes button 44 (FIG. 4D) is pushed.

Figure 4D:
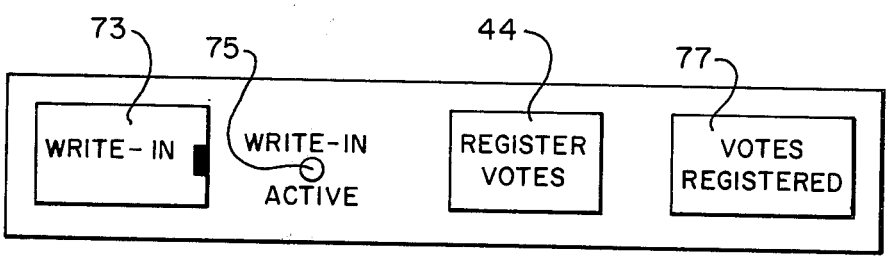

Referring to FIG. 4D, there is shown a front view of the horizontal shelf 123 which houses the write-in active light 75, the write-in door 73, the register votes button 44, and the votes registered light 77.

Figure 5:
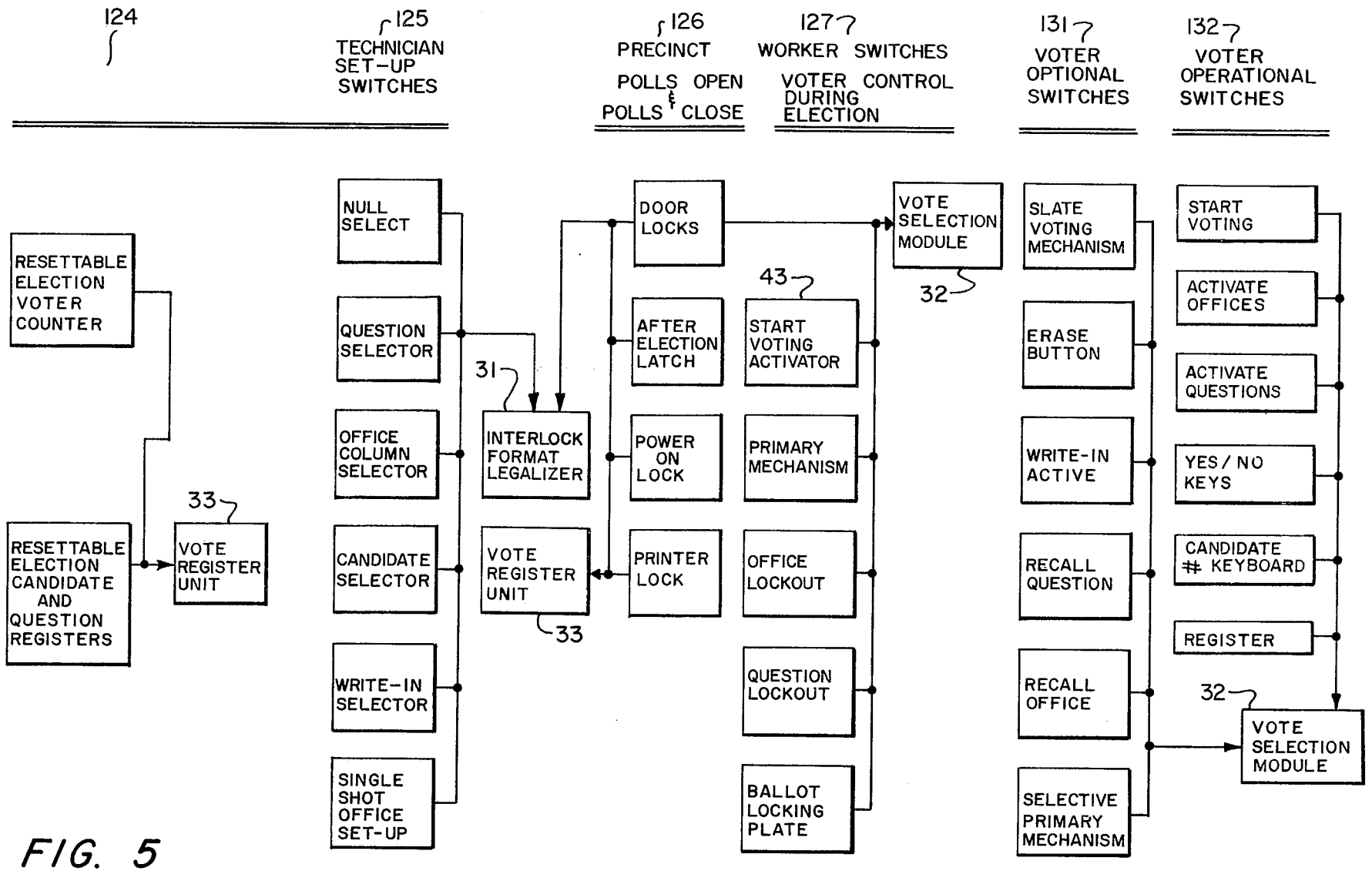
FIG. 5 is a block diagram of the manual input terminals on the electronic voting machine, demonstrating which component apparatus receives a particular input.

Referring now to FIG. 5, there is shown a block diagram of manual input terminals, their associated voting machine components, and the designated operator users. This diagram lists by column the use and location of selecting switches. The first column 124 represents the technicians control switches for the vote registering unit 33; the second column 125 lists the technicians control switches for the format legalizer 31. These are located on the format entry keyboard 181 and are set a week or two prior to the election. The next two columns 126, 127 represent the precinct worker's election day controls: the switches are connected to the interlock format legalizer 31, the vote register unit 33, and the switches which control the vote selection terminal 32 are shown. The voter switches are on the vote selection terminal 32. The next column 131 lists the voter switches not used in every election, or used optionally by the voter, or provided to accommodate a specific implementation of the format legalizer. The last column 132 lists switches generally standard on the vote selection terminal 32.

Referring to FIGS. 6A to 6D, there is shown the write-in mechanism. This write-in mechanism provides a basis for the simplicity of the new invention, because with it, write-in votes are associated with a permanently assigned interlock number, write-ins are integral to the format legalizer 31, and because one box, conveniently located for writing, serves the voter for all write-ins.

Figure 6A:
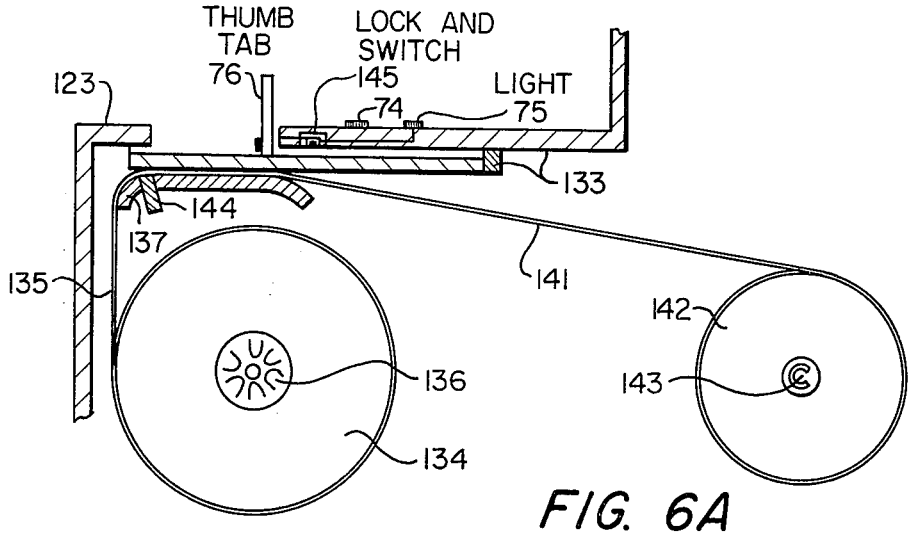
FIGS. 6A to 6E are perspectives and diagram of the write-in apparatus; more particularly.

With reference to FIG. 6A, there is shown a side view of the write-in mechanism. Struts 133 provide structural support for the mechanism. The paper roll 134 is a roll of blank paper which is fed from beneath the write-in shelf 123 in a single layer 135, or with a double copy layer 135, when the center gear 136 turns. The paper is fed across the writing support bar 137 and back along path 141 onto the take up spool 142. The take up spool 142 is turned by a gear 143. The gear 136 of the feeder spool 134 turns simultaneously with the gear 143 of the take up spool 142. Both gears move a measured turn, then lock until turned by the next legal indication of a write-in. Neither roll can be turned by a voter pushing or pulling on the exposed write-in paper; i.e., the voter's access to the write-in paper is limited to a particular portion of paper, thereby preserving the secrecy of previous write-ins, and preventing fraud by preventing more than one write-in at a time. Specific mechanisms for advancing the paper incrementally are known in the art and not a part of this invention.

When the voter pushes the write-in entry bar 74, the format legalizer is searched for the indicated office. If the interlock is full, or if an office is null in the election, nothing happens. If an office is active, and if the interlock is not full, several automatic actions happen in the following sequence: (1) the interlock is set by an increment for an additional vote, and cannot be reset by this voter for this vote, because write-ins cannot be erased; (2) the active office number printer 144 prints the office number on the write-in paper roll; (3) the take up roll 142 turns one measure, in consequence, turning the feed spool 134 one measure, moving the previous write-in out of the write-in box, exposing paper for a new write-in, and showing the office number which is to be associated with this write-in; (4) the lock and switch 145 release, allowing the write-in door to be opened by the voter; (5) the write-in active light 75 lights. The voter then takes the thumb tab 76, shown in the open position, and opens the write-in door.

Figure 6B:
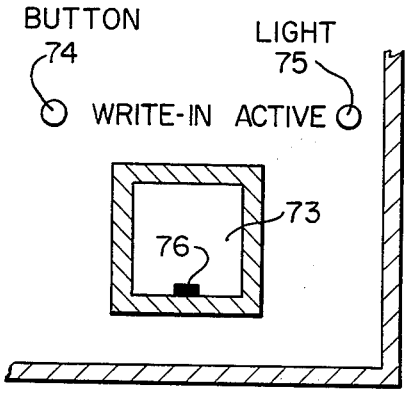

FIG. 6B is a top view of the write-in mechanism showing the write-in door 73 closed. As described above, in order to write in, the voter pushes the write-in button 74, and if the write-in represents a legal choice for the office which is active, the write-in active lamp 75 will light. This drawing illustrates the mechanism for the preferred vote selection terminal of FIG. 3. The only modification necessary for implementation of the alternate vote selection terminal of FIG. 4 is that instead of having one write-in button 74 associated with the write-in door, there are write-in buttons 74A associated with each separate office in the matrix.

Figure 6C:
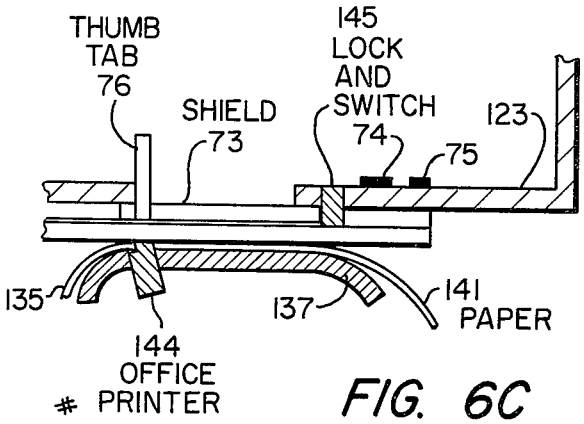

FIG. 6C is a side view of the write-in mechanism, where the write-in door 73 is closed shielding the paper from observation.

Figure 6E:
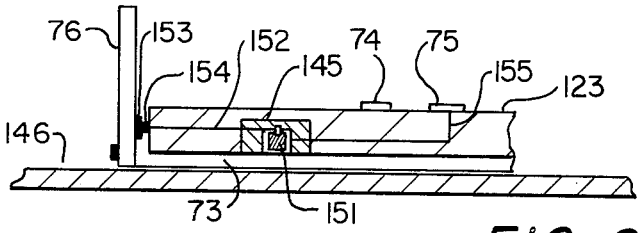
Figure 6D:
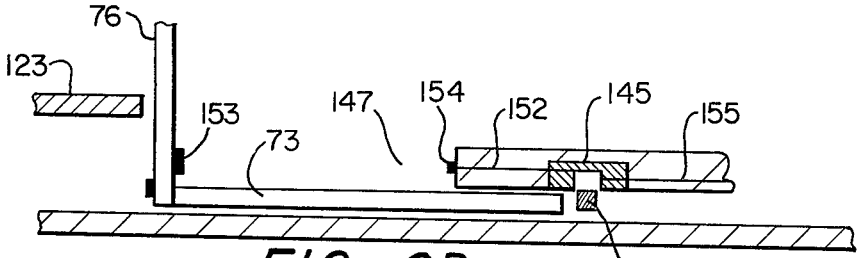

FIG. 6E is a magnified side view showing write-in door 73 open at the top and is shown closed in FIG. 6D at the bottom. Solenoid 151 is controlled by the write-in lock and switch 145. The write-in active light 75, when lighted, sends a signal through a gate 145, the office number counter and printer 144, the paper roll advance 143, on a line 155 to the solenoid 151 in the lock and switch 145. This signal creates a magnetic force that brings the solenoid lock 151 from the lowered position shown at the bottom of FIG. 6D to the raised position shown at the top so that the write-in door 73 can be moved to the open position 146. When the door 73 is opened as far as it can be, the electrical contact 153 on the thumb tab 76 touches the electrical contact 154 on the write-in shelf 123 and sends a signal on line 152 to the lock and switch 145 that cuts off the magnetic force holding the solenoid 151 in the raised position. The signal on line 152 from the contact of the two metal pieces 152, 154, when the door 73 is open, also sends a signal on line 155 to turn off the write-in active light 75. When the write-in door is moved back to the closed position after the write-in is completed, the solenoid lock 151 drops down, and locks the door 73 shut until the next time the write-in active light goes on. Because the solenoid lock 151 is released when the write-in door 73 is moved from the closed position 147 to the open position 146, the door will not re-open. Therefore, the open door 73 position exposes a sign: WARNING DO NOT CLOSE DOOR UNTIL THIS WRITE-IN IS COMPLETE.

Figure 7:
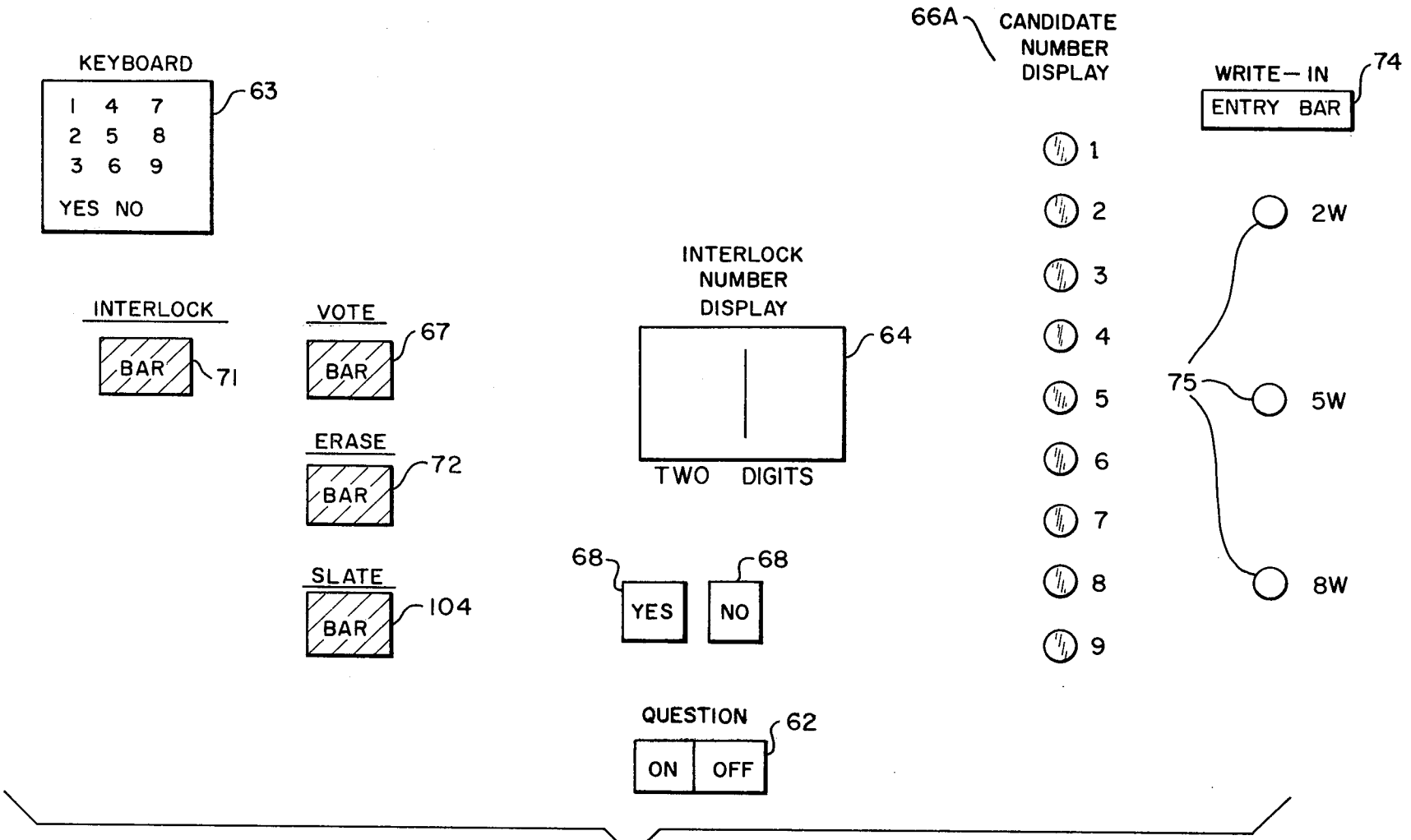
FIG. 7 is an alternate representation of the selection keyboard apparatus.

Referring to FIG. 7, there is shown an alternate representation of the selection key board apparatus 63 where 81 candidates can be selected for 27 offices using a two digit interlock number display. Alternately, by using a three digit interlock number, and one digit candidate number the potential number of candidates and questions displayed rises to 729. Each candidate is assigned a two digit number where the first digit represents an interlock number and is displayed on the interlock number display 64, and the second digit represents the candidate number and is displayed on the candidate number display 66A. The lights numbered one to nine 66A display choices for candidates associated with the displayed interlock number. For questions, two digits are displayed on the interlock number display 64.

The keyboard 63 has decimal keys 1 to 9, and yes, no keys. Candidates are selected by keying the two digits of the candidate number, then pushing the vote entry bar 67. The first digit is displayed on the interlock number display 64. Previous selections associated with the interlock number are immediately displayed on the candidate number display 66A. The selected candidate number is not displayed until the format legalizer has determined that the selection is legal.

This display apparatus illustrates the feature of using a number permanently associated with each candidate, and the formation of offices by creating a cluster of candidate numbers, because in a large office, one with more than 10 candidates, the interlock display will change at least once to represent the same office. While the voter chooses a unique candidate number, there is no unique office number unless it is created with logic in the keyboard encoder 156 that is tied to the format words in the vote selection memory 173. In the preferred apparatus, for large offices, successive interlock digits are displayed to the voter, while one interlock digit may be displayed for three small offices.

Each interlock digit represents three format words as shown in Table B. Table B is set forth on the following page.

TABLE B

| | | Format | Word | Number |
|---|---|---|---|---|
| | 1 | 1 | 2 | 3 |
| Interlock | 2 | 4 | 5 | 6 |
| Number Displayed to the | 3 | 7 | 8 | 9 |
| Voter | 4 | 10 | 11 | 12 |
| | 5 | 13 | 14 | 15 |
| | 6 | 16 | 17 | 18 |
| | 7 | 19 | 20 | 21 |
| | 8 | 22 | 23 | 24 |
| | 9 | 25 | 26 | 27 |

Format words 28 to 32 present in the memory are not used in this configuration.

Previously selected candidates can be erased by reselecting the candidate number on the keyboard 63, then pushing the erase bar 72. The first digit will be displayed on the interlock number display 64, and the second number will disappear from the candidate number display 66A. If a candidate name is keyed 63 and the erase bar 72 is pushed when that number is not previously selected, the candidate will be selected, and if the selection is legal, it will be displayed on the candidate number display 66A. The erase bar 72 is wired to the vote button 67, and an erase is merely a complement to a vote.

Write-ins are selected by keying two digits with keyboard 63 and then pushing the write-in entry bar 74. The first digit is displayed on the appropriate write-in active light 75, 2W, 5W, or 8W. The write-in active light goes on if and only if the interlock for that office is not yet full.

Questions are voted by putting the question switch 62 on. The two digits of the question number are keyed with keyboard 63, and the interlock bar 71 is pushed; both digits of the question number are displayed on the interlock number display 64. A previous choice of yes and no is automatically displayed on the question display 68. Yes or no is voted by pushing the appropriate buttons on the keyboard 63. The choices are displayed by a yes or no light 68 if the vote is legal.

Slates are selected by keying one digit with keyboard 63 and pushing the slate bar 104; legal selections are then automatically displayed sequentially on the interlock number display 64 and the candidate number display 66A.

Figure 8:
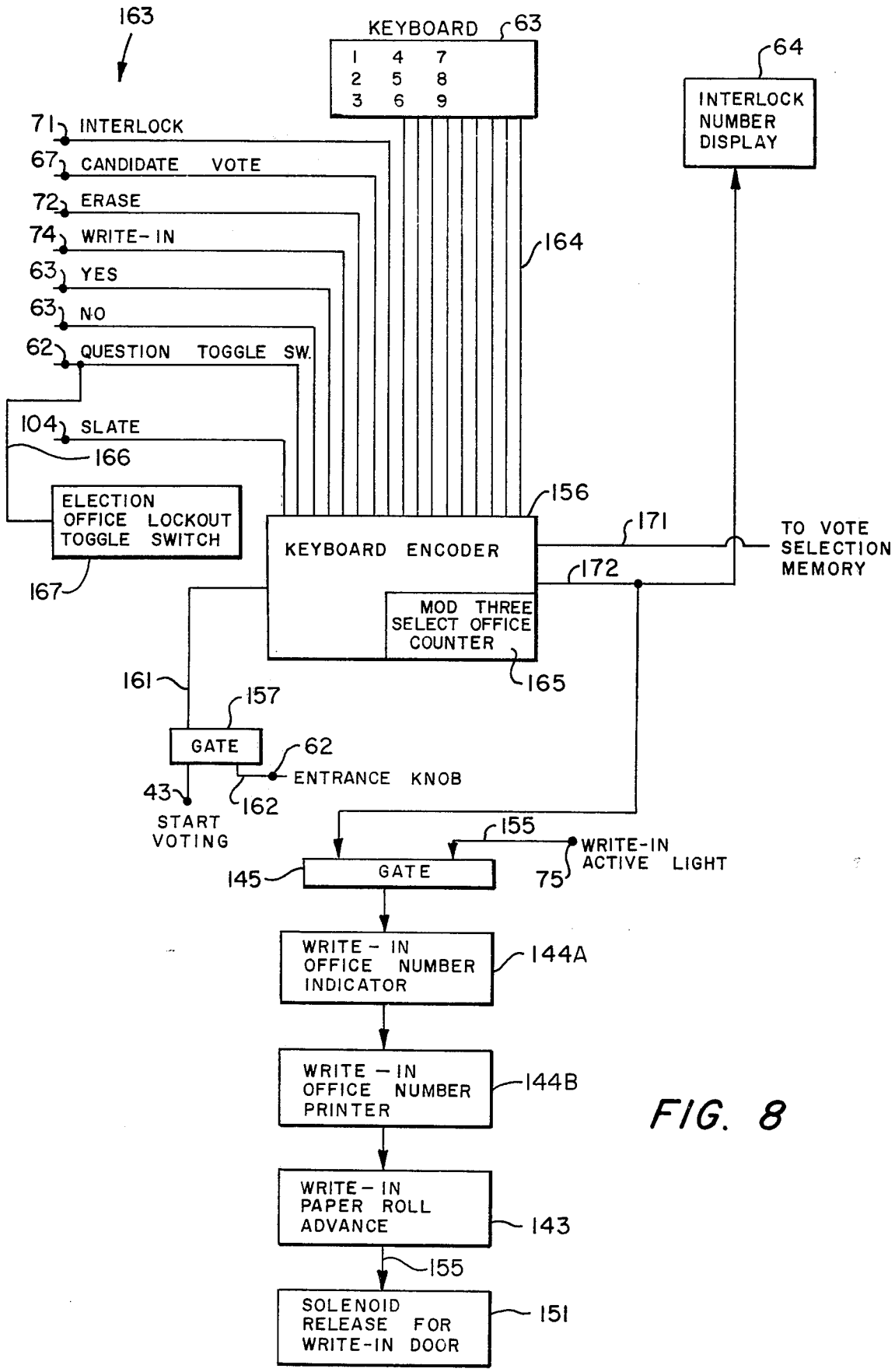
FIG. 8 is a representation of the vote selection keyboard encoder.

Referring to FIG. 8, there is shown a representation of the vote selection keyboard 63 and keyboard encoder 156. The start voting button 43 activates the keyboard encoder 156 on line 161 if the entrance 62 has enabled on line 162 the start voting gate 157. The vote selection keyboard 63 consisting of nine digits, yes, no, and seven entry bars 163 are input on lines 164 to the keyboard encoder 156. Every vote selection is an entry of two digits via keyboard 63 and then the pulse of an entry bar 163. For questions, the switch 62 must be on. Table C shows the effect of each entry bar on a digital key input:

TABLE C

| | | Entry Bars | | | | | | |
|---|---|---|---|---|---|---|---|---|
| | | vote | erase | write-in | slate | interlock | yes/no | question switch |
| Entry Bar Effect on Digital Key Entry | Vote | x | | | | | | |
| | Erase | | x | | | | | |
| | Write-in | | | x | | | | |
| | Slate | | | | x | | | |
| | Question | | | | | x | x | on |

A mod three counter 165 within the keyboard encoder 156 is part of the logic used along with other logic well-known in the state of the art, that associates the interlock digit and the candidate digit with a format word interlock address and candidate address. Only digital combinations which address a candidate number are output on line 171 by the keyboard encoder 156 to the vote selection memory 173. The other output on line 172 from the keyboard encoder 156 is to the interlock number display 64.

The circuitry for the question switch 62 is also connected by line 166 to a toggle switch 167 outside the casing of the voting booth so that the election officer can lock out a portion of the machine as the office or question lockout. When the election officer toggle switch 167 is active, the voter question switch 62 is disabled or locked.

Figure 9A:
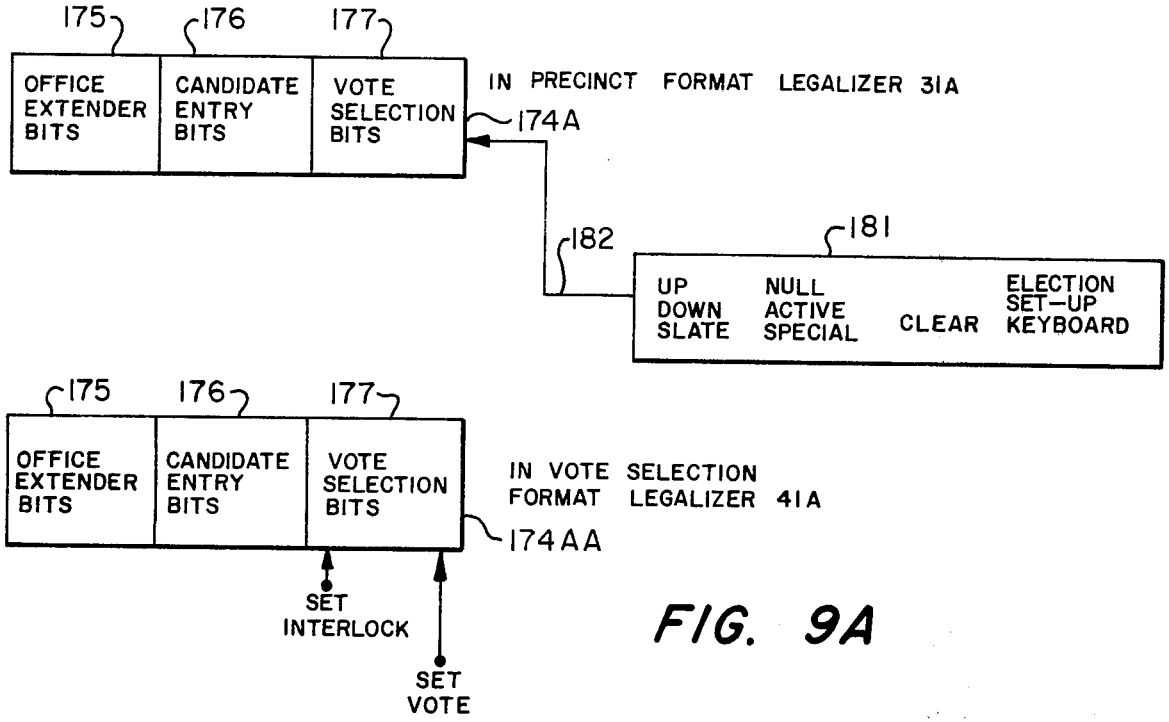
FIG. 9A is a representation of the active status register (ASR) that holds a format word, and of the three subsections of the word.

Referring to FIG. 9A, there is shown a representation of the active status register ASR 174 which is used to evaluate and write into the nucleus of the electronic voting machine - the format word. The first ASR 174A holds the active format word in the precinct format legalizer 31A; the second ASR 174 AA holds the active format word in each vote selection format legalizer 41A.

The format word is an association of twelve bits subdivided into three subwords of four bits each. The vote selections bits 177 receive votes for three candidates and one interlock. An interlock is set with each candidate, question, or write-in vote. The office extender bits 175 describe the length of an office: up, down, or slate to the next format word, or a special situation. They create the code for entering and exiting sequential format words into the vote selection ASR 174AA in a systematic search for an empty interlock within a particular office. The candidate entry bits 176 define whether the vote selection bits 177 for the format word are active or null in a particular election.

The format word is useful because the office extender bits 175 and the candidate entry bits 176 can be set up in the precinct ASR 174A before the election and remain set up throughout the election. Setup in the precinct ASR 174A occurs directly from the format entry keyboard 181 on a write enable line 182. The vote selection bits 177 are cleared in the precinct ASR 174A before the election and are set by each voter in the vote selection ASR 174AA. During the election, voter entry from the vote selection keyboard 63, to the office extender bits 175 and Candidate entry bits 176 is prevented by a write disable for these bits 175, 176 from the format legalizer ROM 194 (FIG. 11) input on a line 195 to the vote selection ASR 174AA. The voting system is essentially tamperproof, because this arrangement makes fraudulent manipulation of the format word easily detectable during and after the election.

Figure 9B:
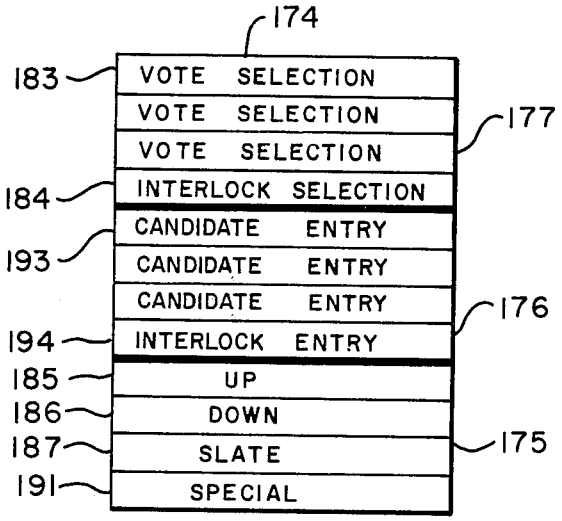
FIG. 9B is a bit representation of the format word within the active status register (ASR)

FIG. 9B is a representation of the active status register ASR 174 giving a clear view of the 12 bit assignments in the format word. There are four selection bits 177. Three vote selection bits 183 are associated with an office interlock selection bit 184. Each vote is indicated on a vote selection bit 183, and an interlock bit 184, except for write-in votes which are incremented in the interlock bit 184, and therefore are not distinct from, and in fact, are the same as office interlocks 184. A write-in vote can never be erased, and does not need a separate vote bit 183, only an interlock bit 184.

Eight format bits 175, 176 control access to the vote selection bits 177. There are four office format bits 175. The up bit 185 sets the upper limits of each office in the first format word of the office. The down bit 186 sets the lower limit in the last format word of the office. Slate voting for the following format word is set by the slate bit 187. The extra bit 191 covers special situations like anti-single shot, primaries, endorsed candidates, and large numbers of slates. There are four entry bits 176 which describe whether a selection bit is active or null. Each vote selection bit 183 has an associated candidate entry bit 193. The interlock selection bit 184 is associated with the interlock entry bit 194.

Figure 10:
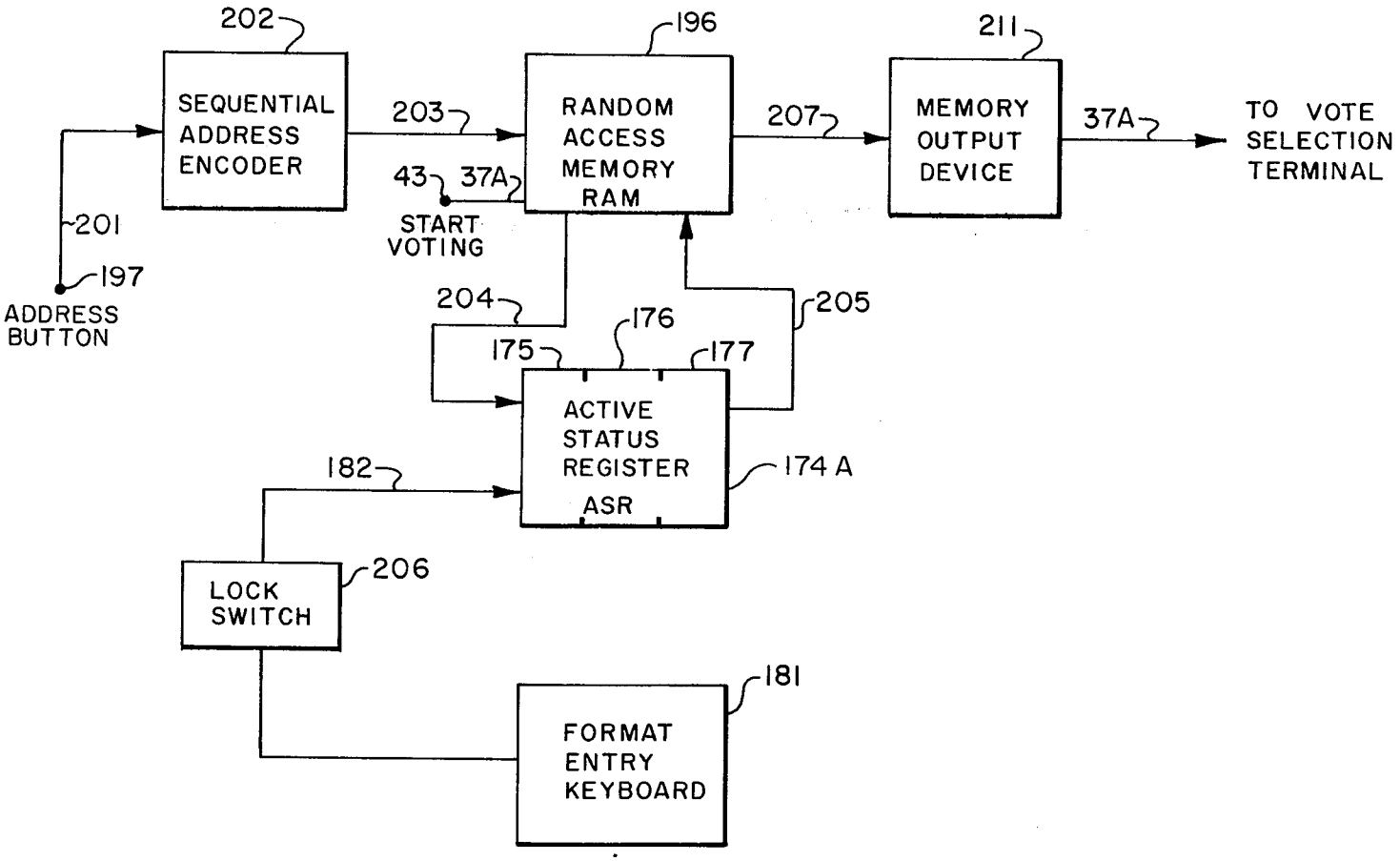
FIG. 10 is a representation of the precinct format legalizer apparatus showing the format entry keyboard that is used to set up for an election.

Referring to FIG. 10, there is shown a block diagram illustrating the logical arrangement of the precinct format legalizer apparatus 31A showing the mechanisms that are used to set up for a particular election. A primary component of the apparatus is the random access memory RAM 196 as large or as small as the total voting machine ballot format capacity. In implementation a sequential memory may be substituted for this or any other RAM described herein with no implied change in the claims that follow hereafter. Discussed herein is a machine with 384 bits of memory arranged in 32 format words of 12 bits each to accommodate electing 32 of 96 total candidates with 256 bits of format legalizer information. Obviously, with more memory, and modification of the display board to three digits, the capacity of the machine can be increased.

For example, a memory of 1,536 bits would allow the formation of 128 format words with 1,024 format bits to control 128 office interlocks and 384 candidates. The following describes the operation of the apparatus without establishing a maximum or minimum capacity.

Only one format word is active at a time, an ASR 174A accommodates one format word. Each 12 bit format word has an address. A set-up terminal address button 197 provides input on a line 201 to the sequential address encoder 202 which provides input on a line 203 to the RAM 196, which in turn deposits the addressed word by input on line 204 to the ASR 174A. Output back to the RAM 196 is on a line 205 after the format word has been set for the election. Each format word in the memory is addressed by the setup technician and set in the manner described above in connection with FIG. 9B to accommodate the ballot format requirements of that particular election using the format entry keyboard 181 and the write enable on line 182. On election day, the format entry keyboard 181 is disabled by an interlock switch and locked cover 206, inserted on the line 182 that serves as the write enable to the ASR 174A. In a similar manner, on election day, access to the entire format legalizer and vote counting mechanism is prohibited by locks and covers.

On election day, the information stored in the precinct legalizer RAM 196, is output via a line 207, to the memory output device 211 where it is output on a line 37A to each vote selection format legalizer 41A in the precinct. The output on a line 37A of the entire contents of the RAM 196 occurs for each voter and is activated by a signal carried on a line 37A from the start voting button 43 of each vote selection terminal 32A.

Figure 11:
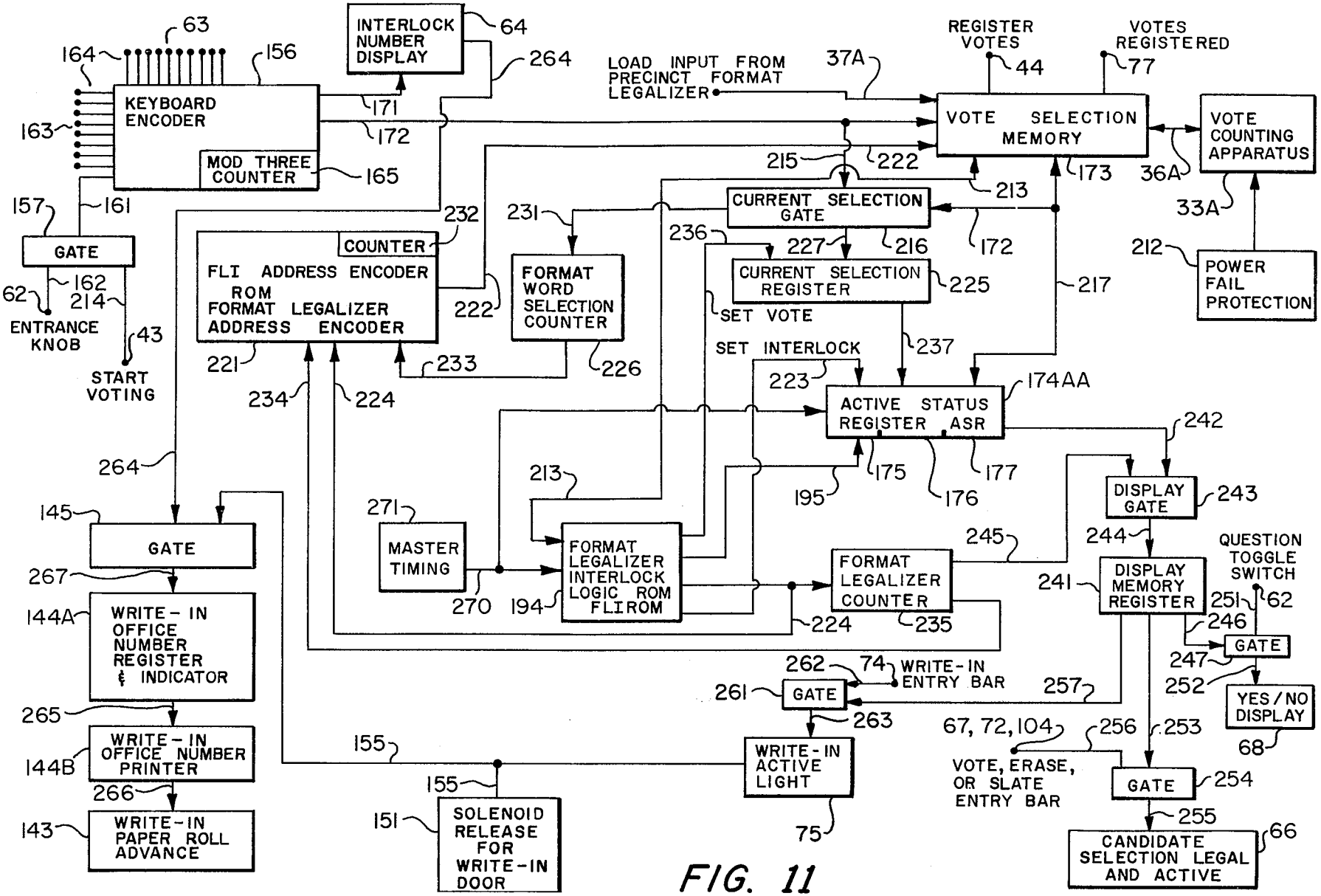
FIG. 11 is a block diagram of the preferred implementation of the vote selection terminal format legalizer apparatus and vote selection memory.

Referring to FIG. 11, there is shown a block diagram illustrating the logical arrangement of the vote selection terminal format legalizer apparatus 41A. The primary functions of the format legalizer are: to check the legality of each selection entered on the vote entry keyboard 63; to use the ASR 174AA and the format legalizer interlock ROM 194 to determine whether a selection is in fact legal; to display only legal selections to the voter on the active selection displays 75, 66, 68; to store only legal selections in the vote selection terminal memory 173 for deposit as votes in the vote counting apparatus 33A which incorporates power fail protection 212; to output on a line 36A the legal votes and blank votes of each voter to the vote counting apparatus 33A after the register votes button 44 is pushed; to clear by output on a line 213 from the format legalizer ROM 194 the entire vote selection memory 173 to Zero after the votes registered signal 77 has been received; and to reload on a line 37A the vote selection memory 173 from the precinct format legalizer memory 196 each time the start voting button 43 is pushed.

More particularly, the vote selection format legalizer apparatus 41A operates in the following manner. The keyboard encoder 156 is enabled by the output of the gate 157 on line 161. The gate 157 is enabled by input on line 214 from the start voting button 43, and input on line 162 from the precinct officer's entrance knob 62 (FIG. 3A) located outside the casing of the vote selection terminal 32. The output of the keyboard encoder 156 in on line 172 that (1) inputs on line 215 to the current selection gate 216 and (2) inputs on line 172 the address of the selected candidate or quesion and the associated format word to the vote selection memory 173. The address to the memory 173 outputs the correct format word on line 217 to the ASR 174AA.

The ASR 174AA evaluates selections: first the selected bit 177 is compared to the candidate entry bit 176 to see if the selection is null; if it is, the selection is not displayed, and does not go through the interlock legalizer sequence. If the selection is active, it is compared to its vote selection bit 177 to see if it has already been voted; if it has, the erase cycle in the FLIROM 194 is activated; if it has not been voted, the vote cycle of the FLIROM 194 is activated. The FLIROM 194 systematically evaluates the format word interlocks using the office extender bit 175 configuration described in FIGS. 9A and 9B. The interlocks assigned to a specific office are searched sequentially by addressing their format words in the vote selection memory 173 from the format legalizer address encoder 221 on line 222 and depositing the addressed format word in the ASR 174AA. In the ASR 174AA the interlock selection bit 184 is searched to see if it has been voted, and is compared to the interlock entry bit 194 to determine null select. If all the interlocks associated with an office are null or full, the selection is nulled and is not displayed to the voter. If there is an empty interlock associated with an office, the interlock is set in the ASR 174AA by an output on a line 223 from the FLIROM 194.

The up, down, slate office extender bits 175 from the ASR 174AA use information contained in the FLIROM 194 to activate on a line 224 the FLIROM address encoder 221. The FLIROM 194 is activated on line 270 by the master timing apparatus 271. The FLIROM address encoder 221 outputs on a line 222 to the vote selection memory 173 to call format words within an office. The FLIROM address encoder 221 contains a counter 232 which is set by the format word selection counter 226 on line 233. The input on line 234 to the format legalizer address encoder 221 of the up down or slate bit from the FLIROM 194 decrements the counter 232 if the office interlock is contained in the next word down, as indicated in the down bit 186 of the ASR 174AA; it increments the counter 232 if the office interlock is contained in the next word up as indicated in the up bit 185, or the slate bit 187 of the ASR 174AA. Each time the FLIROM address encoder counter 232 is incremented or decremented, the vote selection memory 173 is addressed on line 222 and the addressed format word replaces the one which has been in the ASR 174AA. In this manner, format words belonging to a single office are sequentially deposited in the ASR 174AA until an empty interlock is found, or until all format words associated with an office are found to have full interlocks. The format legalizer counter 235 keeps track of which format word interlock of an office is being activated by incrementing when the FLIROM 194 calls a format word that is up in the sequence, and decrementing when the format word called is down in the sequence. After the interlock is set, the FLIROM address encoder counter 232 is incremented or decremented by input on line 234 from the format legalizer counter 235 until the selected candidate format word is addressed, that is, until the format legalizer counter 235 is zero. The FLIROM address encoder counter 232 is reset to zero by input from the format legalizer counter 235 on a line 234, when the format legalizer counter 235 returns to zero, indicating that the format word in the ASR 174AA is the word containing the current selection.

The current selection register 225 and the format word selection counter 226 are both addressed from the current selection gate 216 in a manner well-known in the state of the art. The input to the gate 216 comes from the keyboard encoder 156 on line 215 and the vote selection memory 173 on line 172. The input on line 227 to the current selection register 225 is the address of the selected vote selection bit 183. The input on line 231 to the format word selection counter 226 is the unique number assigned to the format word associated with the current selection. The vote is set by output from the FLIROM 194 on line 236 to the current selection register 225 which ouputs on line 237 to the appropriate vote selection bit 183 in the ASR 174AA.

The first digit of the selection is output from the keyboard encoder 156 on line 171 and is displayed on the interlock number display 64 (FIG. 7). The second digit is the one that is evaluated by the FLIROM 194 in the ASR 174AA to see if it represents a legal vote.

Leagal selections are displayed from the display memory reigster 241. The contents of the ASR 174AA are output on a line 242 through the display gate 243 and input on a line 244 to the display memory register 241 if the display gate 243 is enabled. The display gate 243 is enabled by an output on line 245 from the format legalizer counter 245, when the counter is at zero. The display memory 241 may have had a format word with selections in it, and may receive a new selection that has just been found legal, i.e., a new version of the same format word may be sent to the display memory 241, or the display memory 241 may receive an entirely new format word, indicating there is a new selection from the vote selection keyboard 63. In either case, the format legalizer counter 235 is zero. During the time other format words of an office are being searched with the up, down office extender bits, the format legalizer counter 235 is not zero. Illegal selections are never displayed. Obviously, display of selections from more than one format word are made possible by creating more candidate display lights 66, using more display status registers 241, and addressing via the format legalizer address encoder 221 more format words within the vote selection memory 173 to display votes from even a large office.

The display memory register 241 holds the vote selction bits 177 of the format word. A yes or no vote is output on line 246 to a gate 247, which is enabled by output on a line 251 from the question switch 62. The yes/no display is activated by the output of the gate 247 on line 252. Candidate votes are output on line 253 from the display memory register 241 to the gate 254 which is enabled on line 256 by the vote, erase, or slate entry bars 67, 72, 104 and is output on line 255 to the candidate display 66. Write-in votes are output on line 257 to a gate 261 which is enabled by the write-in entry bar 74 on line 262 and output on line 263 to the write-in active light 75. Previously selected write-in votes are never displayed because the write-in active light 75 indicates that the office interlock has just been set, and that the write-in door will open.

Following is how the write-in door 73 is released. The write-in active light 75 outputs its digit on line 155, and the interlock number display outputs its digit on line 264 through a gate 145, which is enabled by the output on line 155 from the write-in active light 75. The digits are then input on line 267 to the write-in office number indicator 144A which in turn activates on line 265 the write-in office number printer 144B which activates on line 266 the paper roll advance mechanism 143. The write-in active light also activates, after a time delay long enough to advance the paper roll, on line 155 the solenoid 151 which releases the write-in door 73.

Figure 12A:
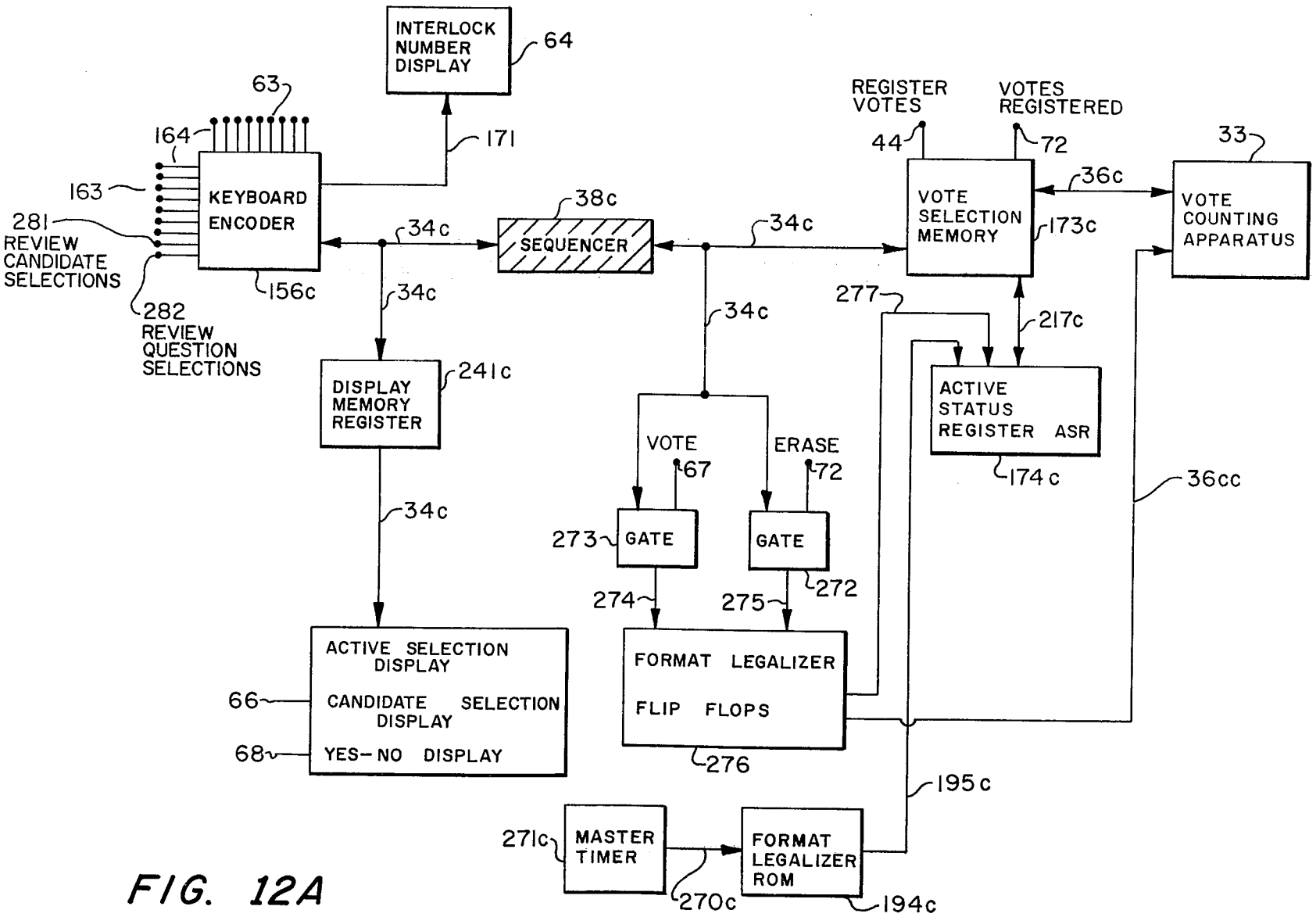
FIG. 12A is a block diagram of the alternate format legalizer apparatus connected to the vote selection memory.
Figure 12B:
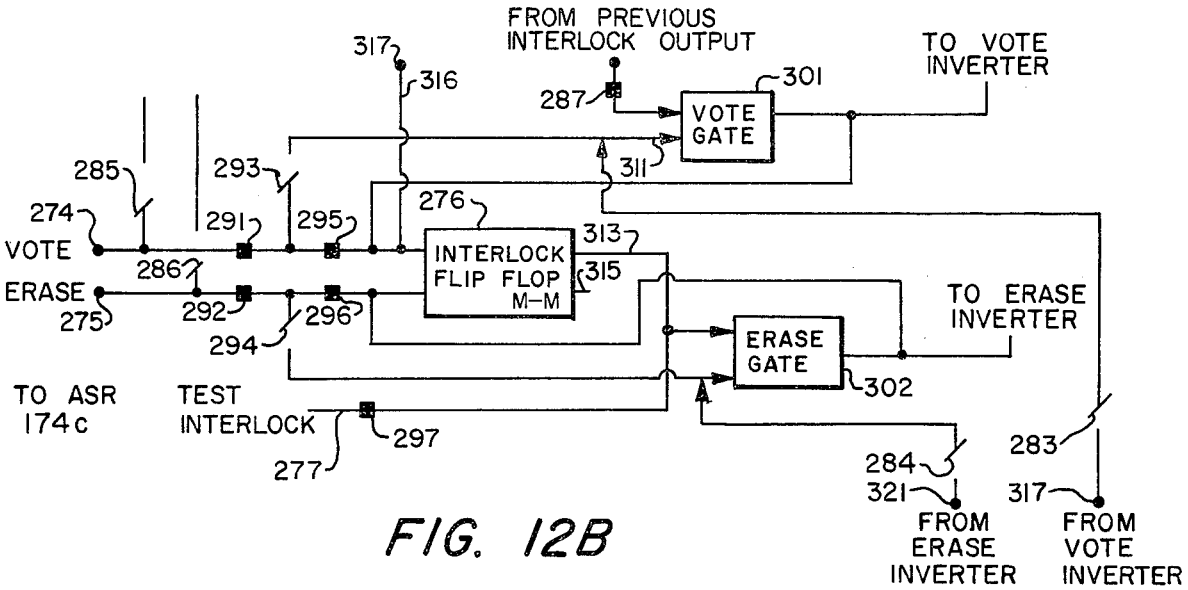
FIG. 12B is a block diagram of a format legalizer interlock flip flop which provides the candidate interlock for a single office, vote for one.
Figure 12C:
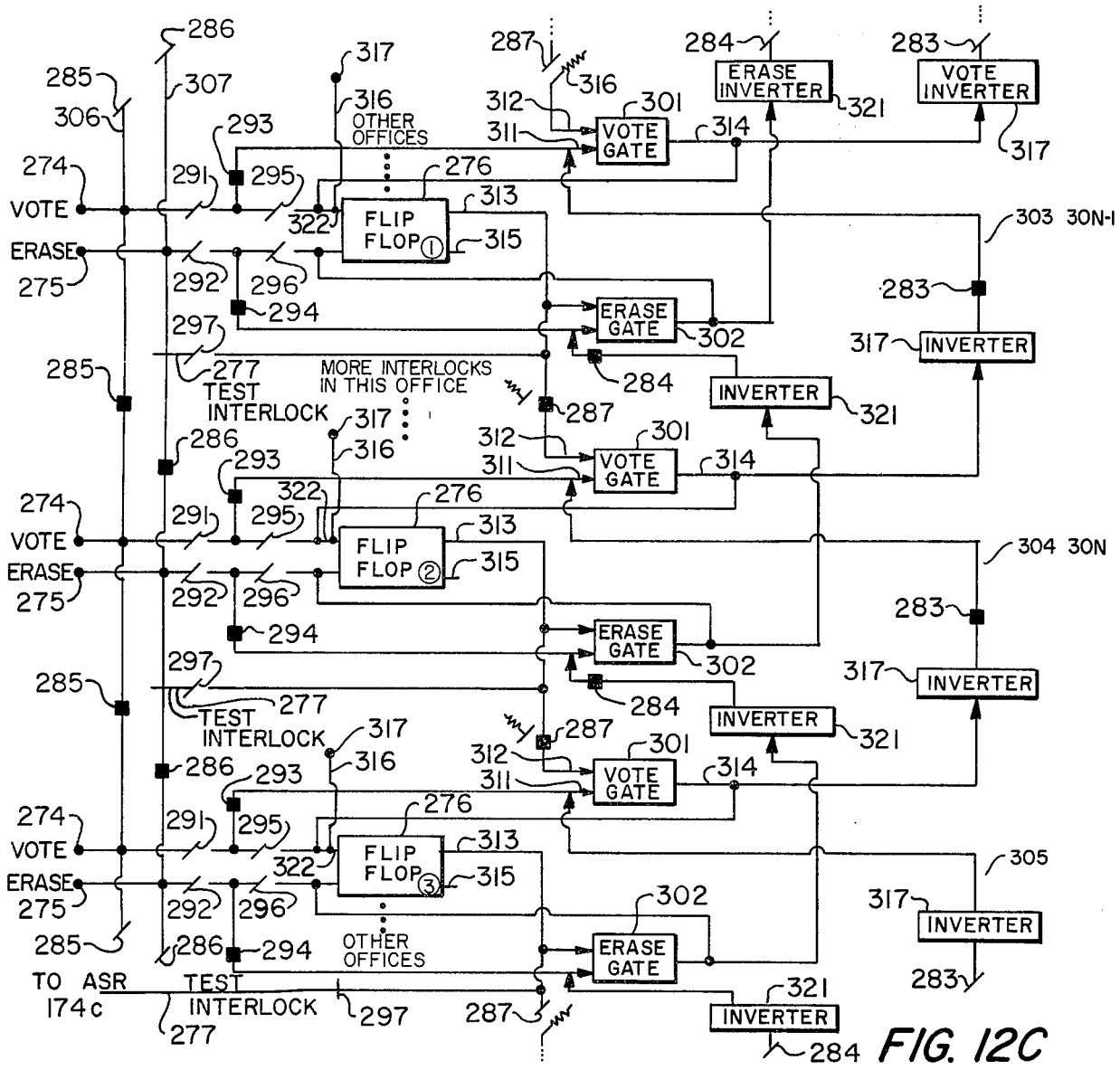
FIG. 12C shows the format legalizer flip flop switches, integral to the single office interlocks, used to form a group office of vote for three.

FIGS. 12A to 12C are block diagrams of an alternate format legalizer interlock apparatus 31 utilizing switches that replace the format office extender bits 175 in the format word. Again this format legalizer can be incoporated in any of the three basic configurations of the electronic voting machine apparatus illustrated in FIGS. 1A, 1B, 1C, but the preferred implementation is that shown in FIG. 1C because, there, the switches can be set once for an entire precinct.

FIG. 12A is a block diagram showing the components of the format legalizer 31C. Eavh vote selection terminal 32C has a keyboard encoder 156C that addresses on a line 34C, through a sequencer 38C, the assigned format word in the precinct vote selection memory 173C. The format word consists of four vote selection bits 177C and four candidate entry bits 176C and no interlock selection bit 184, and no interlock entry bit 194. The candidate entry bits 176C are set prior to the election in exactly the same manner as previously described in connection with FIG. 10. The addressed format word is deposited in the ASR 174C. A vote is set on the addressed vote selection bit 183. If the bit 183 has already been voted, the bit 183 will be complemented instead of set. The FLIROM 194C, activated by the master timer 271C, on line 270C inputs on a line 195C to the ASR 174C the sequence for comparing the vote selection bit 183 to its associated candidate entry bit 193 to see that it is not set null in this election. A null candidate entry bit 193 will cause the vote that was set in the selection bit 183 to be complemented and nulled. The vote selection address output on line 34C from the keyboard encoder 156C, through the sequencer 38C, is also input on line 34C to two gates 272, 273. The vote gate 273 is enabled by the vote button 67. The vote is transmitted on vote line 274 to the flip-flop 276 associated with the selection. The erase gate 272 is enabled by the erase button 72, and the erase is transmitted on erase line 275 to the flip-flops 276 associated with the selection.

The flip-flops 276 output a set vote signal on line 277 to the ASR 174C if there is an empty interlock. When the ASR 174C receives a set vote signal, the format word is output from the ASR 174C on line 217C to the vote selection memory 173C, and output from the vote selection memory 173C on line 34C back through the sequencer 38C to the display memory register 241C for active selection display on the appropriate display 75, 66, 68 which takes place in the manner described above in connection with FIG. 11. If the interlock flip-flop 276 for a specific office is set, the output on line 277 to the ASR 174C so indicates, and the contents of the ASR 174C are dumped and not returned to the vote selection memory 173C.

With this implementation of the format legalizer 31C, it may be useful to offer the voter two additional entry bars on the vote selection terminal 32C: a review candidate selections bar 281, and a review question selections bar 282, which address, through the keyboard encoder 156 on line 34C, a format word in the vote selection memory 173C, through the sequencer 38C, and the format word is returned to the display memory register 241C on line 34C for appropriate display 66, 68 without setting or erasing a selection.

As described above in connection with FIG. 11, when the registered votes button 44 is pushed, the contents of the vote selection memory 173C are output on a line 36C to the vote counting apparatus 33C. In addition, the register votes button 44 signals the format interlock flip-flops 276; the flip-flops which are active in the particular election, but which have not been set by a vote, output on line 36CC to register the blank votes for that office in the vote counting apparatus 33C. When all the votes or blank votes have been properly input, a signal votes registered is returned on line 36C to the vote selection memory 173C, and the votes registered light 72 is lighted.

Referring to FIG. 12B, there is shown a single office interlock flip-flop 276 that allows the voter to vote for one, and no more than one, candidate associated with that office. The vote, or set input is on a line 274, and the erase, or clear input, is on a line 275; both come from the output of the keyboard encoder 156 in the vote selection terminal 32C. Various switches interrupt the transmission lines in order to allow the single office flip-flops 276 to be connected, for the entire length of the machine if necessary, to accommodate large offices. Table C lists the state of the switches which make the flip flop 276 shown in FIG. 12B interlock one and only one selection:

TABLE C

| | Single Office Interlock | | | |
|---|---|---|---|---|
| | Vote | Erase | Test Interlock | Previous Interlock |
| OPEN | 293 | 294 | | |
| | 283 | 284 | | |
| | 285 | 286 | | |
| CLOSED | 291 | 292 | 297 | |
| | 295 | 296 | | |
| DON'T CARE | | | | 287 |

A vote enters the assigned flip-flop 276 on vote line 274. The line input switches 291, 295 are both closed, the next office line switches 283, 285 are both open, and the next interlock vote gate switch 293 is open, so the vote selection sets the interlock flip-flop 276. An erase on line 275 complements the interlock in a manner parallel to the way a vote sets it. Output from the interlock flip-flop on line 297 is closed. The previous interlock switch 287 can be either open or closed.

FIG. 12C is a block diagram which shows three single office interlocks 303, 304, 305 tied together to form a group office of vote for three. As many interlocks can be tied together as needed for a particular office.

Votes and erases from a format word are addressed to a particular interlock flip-flop 276. A vote for the first interlock 303 enters on the vote line 274. The vote signal is connected by line 306 to the vote input 274 of the last interlock 305 in the office. It is prevented from entering the next office by the open switch 285.

A vote entering the last interlock 305 of the office on a line 274 comes through switch 291 which is closed, is sent through the closed switch 293 as an input on a line 311 to the vote gate 301. The open switch 295 prevents the vote signal from entering directly into the set position of the flip-flop 276. The vote gate 301 is enabled on a line 312 if the output on a line 313 of the previous interlock 304 flip-flop 276 has been set. The output on a line 314 of the vote gate 301 is input on a line 314 to the interlock flip-flop 276.

Switches, when set as shown in Tables D, E and F, allow interconnection of many single interlocks to form a group office.

TABLE D

| | First Interlock of Multiple Vote Office | | | |
|---|---|---|---|---|
| | Vote | Erase | Test Interlock | Previous Interlock |
| OPEN | 285 | 286 | 297 | 287 |
| | 291 | 292 | | |
| CLOSED | 283 | 284 | | |
| DON'T CARE | 293 | 294 | | |
| | 295 | 296 | | |

TABLE E

| | Center Interlocks of Multiple Vote Office | | | |
|---|---|---|---|---|
| | Vote | Erase | Test Interlock | Previous Interlock |
| OPEN | 291 | 292 | 297 | |
| CLOSED | 283 | 284 | | 287 |
| | 285 | 286 | | |
| DON'T CARE | 293 | 294 | | |
| | 295 | 296 | | |

TABLE F

| | Last Interlock of Multiple Vote Office | | | |
|---|---|---|---|---|
| | Vote | Erase | Test Interlock | Previous Interlock |
| OPEN | 283 | 284 | | |
| | 295 | 296 | | |
| CLOSED | 285 | 286 | 297 | 287 |
| | 291 | 292 | | |
| | 293 | 294 | | |
| DON'T CARE | | none | | |

There is only one last interlock 305, and only one first interlock 303; they are so called because in voting for a group office, the former is the last to be set, and the latter is the first to be set. Center interlocks can be connected until there are $n - 2$ of them, where n is equal to the number of intrelock flip-flops 276 in the machine.

In the first interlock 303 the switch 287 from the output of the previous interlock is open, and the input on a line 312 to the vote gate 301 is tied high over a line 316 so the gate 301 is automatically enabled when there is a vote input on a line 311.

The center interlock in the same manner, except that switch 287 is closed, and input on a line 311 to the vote gate is enabled by the previous interlock 303 flip-flop 276 output on a line 313 instead of by output on a line 312 from a line 316.

The vote signal comes to the vote gate 301 on a line 311 from an inverter 317 through the closed switch 283. The open line input switch 291 prevents the vote signal from coming directly from the vote line 274. A high output 314 of the vote gate 301 is sent as a set input on a line 322 to the flip-flop 276. A low output of the vote gate 301 becomes a high input to the next sequential vote gate 301 because of the vote inverter 317.

After the last interlock 305 flip-flop 276 is set, output on a line 277 to the ASR 174C of the test interlock will disable the output of the ASR 174C, and the contents will be dumped. The test interlock output on a line 277 can only come from the last interlock 305 in an office. All the other test interlock lines 277 are disabled because the test interlock switches 297 are open.

It should be noted that the erase gate 302 is enabled by the output on a line 313 from its own associated interlock 3on flip-flop 276, while the vote gate 301 is enabled by the output on a line 313 from the next sequential interlock 3on-1 flip-flop 276.

The interlock empty output on a line 315 of the interlock flip-flop 276 provides the count of blank votes for an office in the vote registering apparatus 33C. Prior to an election, all unused interlock flip-flops 276 are preset high on a line 316 from a switch 317. Because they are preset high, the interlocks prevent the voter from registering illegal votes; in addition, they do not register blank votes in the vote counting apparatus 33C.

Figure 13:
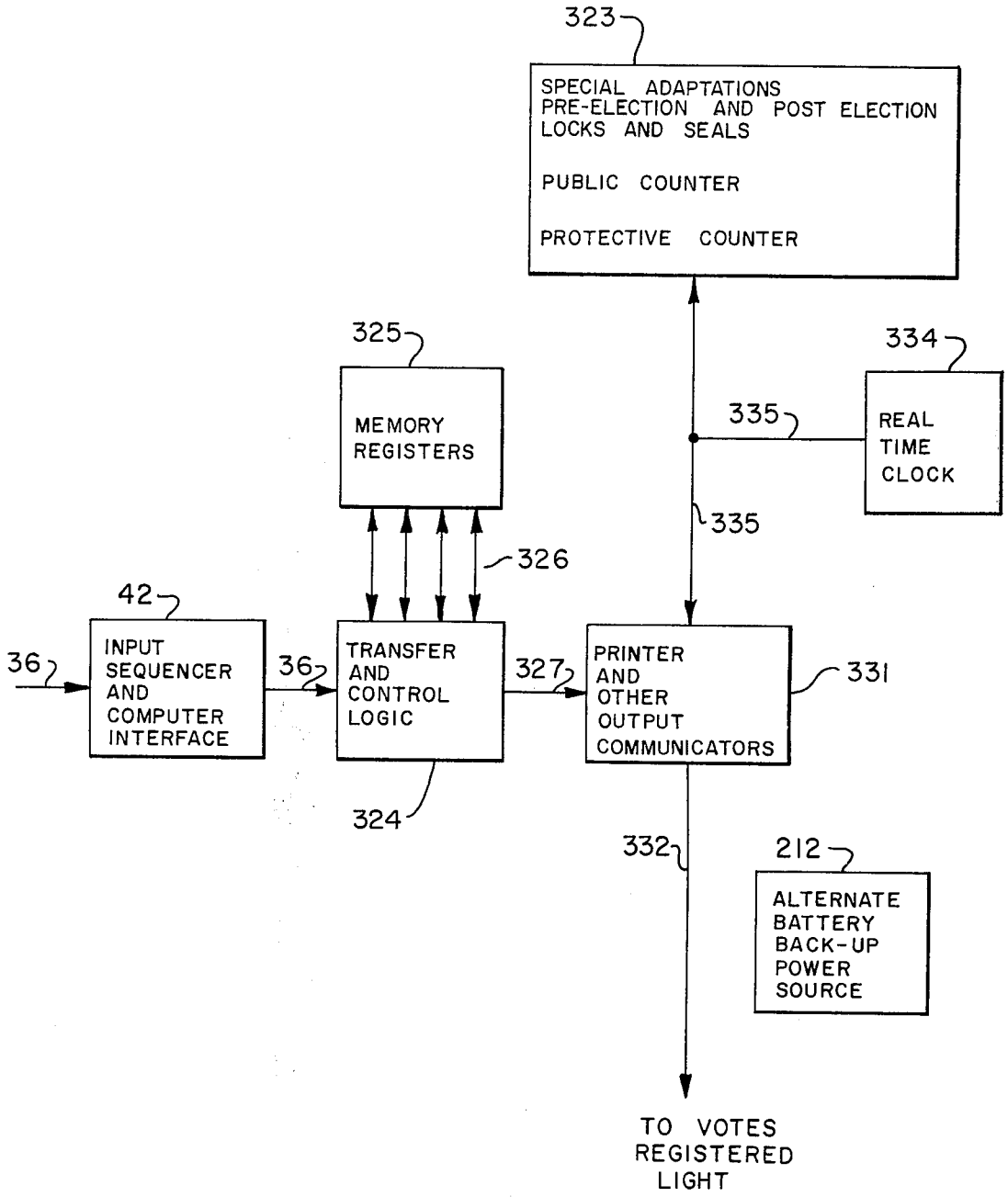
FIG. 13 is a block diagram of the vote counting apparatus.

Referring to FIG. 13, there is shown a block diagram of the vote counting apparatus 33, which may be a small, special purpose, minicomputer like the DEC PDP 8, the HP 2100, or a Data General Nova. Special adaptions 323 are typically included on whatever equipment is used to count votes: pre-election and post-election locks and seals, a resettable public counter, a nonresettable protective counter, and preferably a real time clock 334. All these appratus serve the protective function of making attempted election fraud detectable. The clock 334 registers the time on a line 335 on the pre-election zero proof sheet print-out, the 5 minute interval print-outs, and the print-out of the results after the polls close. A record of the vote counts are printed at 5 minute intervals throughout the election to guard against fraudlent manipulation of the votes at any stage of the vote registering process, to prevent manipulating of the various memories and to provide a partial election total in case the vote registering unit 33 quits working and needs to be replaced by a standby unit during the election.

Input on a line 36 to the vote counting apparatus 33 is controlled by the sequencer 42 and computer interface 42. The transfer and control logic 324 are controls within the computer that associate on lines 326 specific votes with specific vote memory registers 325, and associate on lines 326 specific blank votes, with specific vote memory registers 325. The transfer and control logic 324 also transfer votes on line 327 from the vote memory registers 325 to the printer and output communicators 331.

The printer 331 provides a printed readout of the contents of the vote memory registers 325 before the polls open, every 5 minutes during the election, and after the polls close. Only the beginning and ending vote totals are available to the precinct workers; the record of the votes made during the day is locked and cannot ve viewed, except in the event of a recount.

There is a special output communicator 331 that sends a votes registered signal 77 on line 332 from the vote counting apparatus 33 to the vote selection module 32 after a voter's votes and blank votes have been registered.

The election process should preferably depend on a power source available in a building where the voting is taking place, because the election could be stopped if someone unplugged the machine, cut off the building power by pulling a circuit breaker, or if the electricity went off because of a storm or some natural disaster. An alternate power source 212 is preferably available so that the election can continue if power is lost.

The specific techniques for accumulating and printing out votes is not a part of this invention and apparent to those skilled in the art. The invention facilitates this accumulation. In an especially convenient form of the invention with each potential selection identified by a unique number, the computer need only accumulate the number of each of these numbers, and the printout of the total of each number will be the number of votes cast for that selection, blanks being identified by a unique number also. The invention thus facilitates accounting for every affirmative and blank vote cast in an especially convenient manner.

The invention also facilitates secure setup before each election through keyboard selection, detachable wire connections and/or operation of switches to establish the acceptable number of votes for each office.

It is evident that those skilled in the art may now make numerous other uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Voting apparatus comprising, display means for displaying items to be voted upon and an item that is selected, means for selecting an item to be voted upon to provide a uniquely representative digital address signal, vote selection storage means coupled to said means for selecting, means coupled to said means for selecting for entering a voter's choice in a location in said vote selection storage means designated by said digital address signal to provide a vote signal for temporary storage, means for conditioning said vote selection storage means to have available a number of vote storage spaces corresponding to the maximum number of legal votes designated for the item then being voted upon and the partition said vote storage spaces by designating the beginning and end of the spaces associated with an item then being voted upon, means for transferring each vote signal only to a previously vacant vote selection storage means vote storage space, means for indicating when a vote selection storage means storage space then stores a vote signal, means coupled to said vote selection storage means responsive to all the vote storage spaces partitioned for storing a particular vote signal for providing a full signal, means responsive to said full signal for preventing additional vote signals from being accepted for counting, accumulating means coupled to said vote selection storage means for receiving vote signals from said vote selection storage means and accepting them for counting, and means for effecting transfer of said vote signals from said vote selection storage means to said accumulating means after each voter completes his selections.

2. Voting apparatus in accordance with claim 1 and further comprising means for establishing each vote signal as a digital representation of the selected voter choice for a particular item, and said accumulating means includes means for counting the number of times each digitally encoded choice is transferred from said temporary storage means to said accumulating means to thereby provide an indication of the total number of votes cast for an item.

3. Voting apparatus in accordance with claim 1 and further comprising means coupled to said vote selection storage means for displaying an indication of the vote signal then in vote selection storage for an item to be voted upon to thereby inform the voter of his choice then in vote selection storage awaiting transfer to said accumulating means, and means coupled to said vote selection storage means for cancelling the vote then in said vote selection storage means to enable a voter to make a different choice before transfer of vote signals from said vote selection storage means to said accumulator means.

4. Voting apparatus in accordance with claim 1 and further comprising means for providing a blank count signal representative of the difference between said maximum number and the number of choices made by the voter for vote storage spaces associated in one partition, and means for transferring said blank count signal to said accumulating means when said means for effecting transfer of said vote signals from said vote selection storage means to said accumulating means effects transfer of said vote signals from said vote selection storage means to said accumulating means.

5. Voting apparatus in accordance with claim 1 and further comprising, a write-in means for receiving write-in votes, means for providing a write-in signal when a voter wants to write in a vote, means responsive to said write-in signal for enabling said write-in means, said write-in means including a normally covered writing surface for receiving a write-in vote uncoverable only in response to at least said write-in signal, means responsive to said write-in signal for providing a write-in vote signal to said vote selection storage means, and means responsive to the voter covering said writing surface for causing the writing surface just written upon to be moved to a hidden storage area whereby a write-in voter may see only his own write-in votes.

6. Voting apparatus in accordance with claim 5 wherein said write-in means includes opaque movable normally locked door means for normally covering said writing surface, means responsive to at least said write-in signal for unlocking said movable door means to allow the voter to open said door means and write his vote upon said writing surface, and means responsive to the voter closing said door means for both causing the writing surface just written upon to move to said hidden storage area and for then locking said door means whereby a voter can write in only one choice for each write-in signal.

7. Voting apparatus in accordance with claim 1 and further comprising, means responsive to the transfer of said vote signals from said vote selection storage means to said accumulating means for storing each voter choice upon a recording medium.

8. Voting apparatus in accordance with claim 7 wherein said last-mentioned means for storing comprises printing means and a tape for receiving printed impressions of the symbols corresponding to voter choices transferred from said vote selection storage means to said accumulating means.

9. Voting apparatus in accordance with claim 1 and further comprising storage register means associated with each item for storing the maximum associated with that item for that election, and disconnectable means for providing each storage register means with a maximum number signal associated with that item for that election prior to the election while preventing the maximum vote signals thus stored in each storage means from being changed during the election when said disconnectable means is disconnected from the rest of said apparatus during that election.

10. Voting apparatus in accordance with claim 1 wherein said means for indicating when a vote storage space is full comprises an interlock means for each vote storage space, each interlock means assuming initially a reset state before a voter makes his choice and a set state in response to the voter making that choice corresponding to the order number of the respective interlock means, and said means responsive to said full signal and the provision of another vote signal for that digital address comprises means for sensing the state of the last of said interlock means assoicated with a particular digital address signal for blocking any additional vote signals from entering vote selection storage when said last of said interlock means assumes the set state.

11. Voting apparatus in accordance with claim 10 and further comprising means for transferring to said accumulating means a designation of each interlock means then in said reset state when said vote signals are transferred from said vote selection storage means to said accumulating means to thereby accumulate a signal representative of the number of blank votes associated with the each vote storage space partitions just voted upon.

12. Voting apparatus in accordance with claim 1 and further comprising means responsive to the uniquely representative digital address signal for addressing a uniquely corresponding vote storage space.

13. Voting apparatus in accordance with claim 1 and further comprising, means for sequentially addressing the vote storage spaces corresponding to the maximum number of legal votes designated for the then being voted on item, and means for transferring each vote signal only to a previously vacant vote selection storage means storage space.

14. Voting apparatus in accordance with claim 1 wherein said display means for displaying items to be voted upon includes means defining a symbol beside each displayed choice available to a voter and said means for selecting an item to be voted upon comprises keyboard means operable by a voter and having symbols thereon related to the symbols associated with said display means so that a voter may actuate keys on said keyboard means associated with said symbols and thereby make choices by actuating keys on said keyboard means associated with corresponding symbols on said display means.

15. Voting apparatus comprising, display means for displaying items to be voted upon and displaying items voted upon, means for entering a voter's choice by providing a digital vote signal uniquely characteristic of that choice, format storage means for storing a number of digital format words uniquely identifying items being voted upon corresponding to the number of available selections in the election for identifying whether a vote signal then represents a legal voter's choice, vote selection storage means for storing legal vote signals coupled to said format storage means, accumulating means coupled to said vote selection storage means and said format storage means which accepts votes for counting, and means responsive to each digital vote signal, and the stored digital format words for transferring each digital vote signal to said accumulating means only when a digital vote signal represents a legal voter's choice.

16. Voting apparatus in accordance with claim 15 and further comprising legal vote selection display means coupled to said vote selection storage means and coupled to current selection storage means for displaying a legal voter's choice represented by a digital vote signal then in said current selection storage means only when said means responsive to each digital vote signal and the stored digital format words transfers a digital vote signal to said vote selection storage means so that said display means displays to the voter only the voter's legal choices.

17. Voting apparatus in accordance with claim 15 wherein said format storage means stores digital format words identifying vote signals that may be legal choices in the election being voted upon, identifying limits to indicate the item with which a vote signal representative of such a legal choice is associated and identifying the maximum number of legal choices for each item, whereby said means responsive to said digital vote signal and the stored digital format words receives enough information for determining the legality of each digital vote signal provided in response to each voter's choice.

18. Voting apparatus in accordance with claim 16 wherein said display means includes a display register coupled to the vote selection storage means for storing a digital vote signal representative of a legal voter's choice, and visible display means coupled to said vote selection storage means and coupled to said display register and responsive to the digital vote signal stored in said display register for providing a visible indication of the legal choice selected by the voter then voting.

19. Voting apparatus in accordance with claim 15 wherein said format storage means comprises a random access memory.

20. Voting apparatus in accordance with claim 15 comprising means responsive to each unique digital vote signal for determining whether that digital vote signal is representative of an available choice for any item in the election being voted upon, means responsive to a digital vote signal that is representative of an available choice for any item in the election being voted upon for determining whether the voter's choice represented thereby is then legal, and further comprising means for displaying to the voter visual representations of only legal choices characterized by digital vote signals stored in said vote selection storage means.

21. Voting apparatus in accordance with claim 15 and further comprising, acumulating means coupled to said temporary storage means for receiving digital vote signals from said temporary storage means, blank vote storage means for storing a blank signal representative of the difference between the number of available choices for each item and the number of choices made by the voter then voting for that item, and means for effecting transfer of said digital vote signals from said temporary storage means and of each blank signal from said blank vote storage means to said accumulating means.

22. Voting apparatus in accordance with claim 15 and further comprising means for calling up a format word that is at least one of up or down in the sequence.

23. voting apparatus in accordance with claim 15 wherein vote selection storage means vote storage spaces may assume a set or reset state in a random manner being set from one of and reset from another of the top, bottom, or a point designated by the uniquely representative digital address signal.

* * * * *